US011534037B2

(12) United States Patent
Johnson et al.

(10) Patent No.: US 11,534,037 B2
(45) Date of Patent: Dec. 27, 2022

(54) AUTOMATED WETTED OR DRY SHEET PRODUCT DISPENSERS

(71) Applicant: GPCP IP HOLDINGS LLC, Atlanta, GA (US)

(72) Inventors: Alan Joseph Johnson, Brillion, WI (US); Timothy Andrew Robertson, Appleton, WI (US); Ted Allen Casper, Kaukauna, WI (US); Matthew Keith Florian Williquette, Appleton, WI (US)

(73) Assignee: GPCP IP HOLDINGS LLC, Atlanta, GA (US)

( * ) Notice: Subject to any disclaimer, the term of this patent is extended or adjusted under 35 U.S.C. 154(b) by 385 days.

(21) Appl. No.: 16/795,629

(22) Filed: Feb. 20, 2020

(65) Prior Publication Data

US 2020/0281420 A1 Sep. 10, 2020

Related U.S. Application Data

(60) Provisional application No. 62/813,288, filed on Mar. 4, 2019.

(51) Int. Cl.
*A47K 10/36* (2006.01)
*A47K 10/32* (2006.01)

(52) U.S. Cl.
CPC .... *A47K 10/3625* (2013.01); *A47K 2010/328* (2013.01); *A47K 2010/3668* (2013.01); *A47K 2010/3681* (2013.01)

(58) Field of Classification Search
CPC ..... A47K 2010/328; A47K 2010/3273; A47K 10/3625; A47K 2010/3668; A47K 2010/3681; A17K 10/32
(Continued)

(56) References Cited

U.S. PATENT DOCUMENTS 3,862,616 A 1/1975 Brady
5,441,189 A 8/1995 Formon et al.
(Continued)

FOREIGN PATENT DOCUMENTS

CN 2486091 Y 4/2002
EP 1 181 884 B1 11/2007
(Continued)

OTHER PUBLICATIONS

Evriholder PTH-SB-2 Spray'N Swipe; retrieved Feb. 19, 2020 from https://www.amazon.ae/Evriholder-PTH-SB-2-SprayN-Swipe-1-Piece/dp/B008AW4MPE.
(Continued)

*Primary Examiner* — Ghassem Alie

(57) ABSTRACT

An example sheet product dispenser includes a housing with a base portion and a loading door. A motor drives a base portion roller or a loading door roller to cause dispensing of the sheet product along a sheet product path and through an outlet. A pump is in fluid communication with a liquid reservoir and a spray mechanism, and is configured to cause liquid from the reservoir to spray onto the sheet product through the spray mechanism prior to dispensing. A controller is configured to determine whether to operate in either a dry mode or a wet mode based on user input provided. When in the dry mode, the controller causes the motor to operate to dispense dry sheet product. When in the wet mode, the controller causes the motor to operate and the pump to operate to dispense wetted sheet product.

21 Claims, 19 Drawing Sheets

(58) Field of Classification Search
USPC ..... 181/663, 32, 40, 43, 314, 355; 242/908, 242/596.8, 597.8, 598.6, 615; 134/44, 134/201
See application file for complete search history.

(56) References Cited

U.S. PATENT DOCUMENTS

| | | | | |
|---|---|---|---|---|
| 5,443,084 | A * | 8/1995 | Saleur | A47K 10/32 134/201 |
| 5,887,759 | A * | 3/1999 | Ayigbe | A47K 10/32 118/325 |
| 6,319,318 | B1 | 11/2001 | Pekarek et al. | |
| 6,412,679 | B2 | 7/2002 | Formon et al. | |
| 6,419,136 | B2 | 7/2002 | Formon et al. | |
| 6,457,434 | B1 * | 10/2002 | Lazar | A47K 10/32 118/325 |
| 6,710,606 | B2 | 3/2004 | Morris | |
| 6,742,689 | B2 | 6/2004 | Formon et al. | |
| 6,745,927 | B2 | 6/2004 | Formon et al. | |
| 6,766,977 | B2 | 7/2004 | Denen et al. | |
| 6,830,210 | B2 | 12/2004 | Formon et al. | |
| 6,871,815 | B2 | 3/2005 | Moody et al. | |
| 7,114,677 | B2 | 10/2006 | Formon et al. | |
| 7,191,977 | B2 | 3/2007 | Denen et al. | |
| 7,237,744 | B2 | 7/2007 | Morris et al. | |
| 7,270,292 | B2 | 9/2007 | Rasmussen | |
| 7,341,170 | B2 | 3/2008 | Boone | |
| 7,624,664 | B2 | 12/2009 | Morris et al. | |
| 7,698,980 | B2 | 4/2010 | Morris et al. | |
| 7,784,424 | B2 | 8/2010 | Wentworth et al. | |
| 7,832,679 | B2 | 11/2010 | Denen et al. | |
| 7,845,593 | B2 | 12/2010 | Formon et al. | |
| 7,856,941 | B2 * | 12/2010 | Nelson | B65H 35/0046 118/301 |
| 7,861,964 | B2 | 1/2011 | Cittadino et al. | |
| 7,887,005 | B2 | 2/2011 | Troutman et al. | |
| 8,162,252 | B2 | 4/2012 | Cittadino et al. | |
| 8,186,551 | B2 | 5/2012 | Morris et al. | |
| 8,632,030 | B2 | 1/2014 | Troutman et al. | |
| 9,078,546 | B2 | 7/2015 | Kaufmann | |
| 9,474,422 | B1 | 10/2016 | Troutman et al. | |
| 9,604,811 | B2 | 3/2017 | Case et al. | |
| 9,642,503 | B1 | 5/2017 | Troutman et al. | |
| 9,999,326 | B2 | 6/2018 | Borke et al. | |
| 10,201,255 | B2 | 2/2019 | Brants | |
| 10,285,544 | B2 | 5/2019 | Perlas et al. | |
| 10,478,022 | B2 | 11/2019 | Duarte et al. | |
| 10,806,310 | B2 | 10/2020 | Mann et al. | |
| 10,835,087 | B2 | 11/2020 | Duarte et al. | |
| 2002/0113163 | A1 * | 8/2002 | Lazar | A47K 10/32 242/570 |
| 2005/0051663 | A1 * | 3/2005 | Walters | A47K 10/38 242/597.8 |
| 2009/0101665 | A1 | 4/2009 | Mulhern | |
| 2010/0032443 | A1 | 2/2010 | Mueller et al. | |
| 2011/0088619 | A1 | 4/2011 | Duerrstein | |
| 2018/0064297 | A1 | 3/2018 | Goeking et al. | |
| 2020/0154957 | A1 * | 5/2020 | Abraham | A47K 10/3643 |
| 2020/0323400 | A1 | 10/2020 | Williams et al. | |
| 2020/0329926 | A1 | 10/2020 | Vail et al. | |

FOREIGN PATENT DOCUMENTS

| | | | | |
|---|---|---|---|---|
| WO | WO-2005087068 | A1 * | 9/2005 | A47K 10/32 |
| WO | WO-2007105208 | A2 * | 9/2007 | A47K 10/32 |
| WO | WO-2010072298 | A2 * | 7/2010 | A47K 10/32 |

OTHER PUBLICATIONS

Windex Touch-Up; retrieved Feb. 19, 2020 from https://www.amazon.com/Windex-Touch-Up-Cleaner-Multi-Surface-Disinfectant/dp/B00AJLYILM.
Gemstar Disposable Towel Solutions; retrieved Feb. 19, 2020 from https://www.gemstaruk.com/.
Wet Towel Dispenser (Hot and Cold); Shourya Enterprises; retrieved Feb. 19, 2020 from https://www.indiamart.com/shouryaenterprises/other-products.html.
HT1005 Wet Towel Dispenser; Hasuco Korea; retrieved Feb. 19, 2020 from http://www.hasuco.com/elec/elec_01a.htm.
Maldonado; MORI-03 BENS Hot Towel Dispenser; retrieved Feb. 19, 2020 from https://www.dailymotion.com/video/x46i4ho.
Sterilizing Paper Towel Dispenser (Wet Towel Machine); Shenzhen Bens Intelligent Appliance Co., Ltd; retrieved Feb. 19, 2020 from http://shenzhenbens.sell.everychina.com/p-95915401-sterilizing-paper-towel-dispenser-wet-towel-machine.html.
GHT Hot Towel Dispenser Warmer for Salon, Spa, or Restaurant NIB; retrieved Feb. 19, 2020 from https://www.amazon.com/towel-dispenser-warmer-salon-restaurant/dp/b002x123r2.
NSD-03A Wet Towel Dispensers Wet Wipes Machine; retrieved Feb. 19, 2020 from https://www.aliexpress.com/i/32800373299.html.

* cited by examiner

AUTOMATED WETTED OR DRY SHEET PRODUCT DISPENSERS

CROSS-REFERENCE TO RELATED APPLICATION(S)

The present application claims priority to U.S. Provisional Application No. 62/813,288, entitled "Automated Wetted or Dry Sheet Product Dispensers", filed Mar. 4, 2019, the contents of which is incorporated by reference herein in its entirety.

FIELD OF THE INVENTION

Example embodiments of the present invention generally relate to dispensers and, more particularly to, sheet product dispensers capable of providing wetted sheet product on-demand.

BACKGROUND

On-demand sheet product (e.g., paper towel, tissue, napkin, etc.) dispensers are useful in many environments. Providing an on-demand dry sheet product dispense to a user can be useful for a variety of reasons (e.g., cleaning surfaces, absorbing wet messes, providing a clean napkin, providing a tissue, etc.). Providing an on-demand wetted sheet product dispense to a user could, however, be more useful in some situations (e.g., disinfecting a surface, removing a stain, removing stuck on food or other particles, etc.). Thus, it may be beneficial to have the option to utilize a dry sheet product or a wet sheet product.

BRIEF SUMMARY

Embodiments of the present invention provide automated on-demand sheet product that is optionally either wetted or dry. In this regard, the user of the sheet product dispenser has the option prior to dispense to choose whether a dry sheet product dispense or a wet sheet product dispense occurs. In some cases, the user may provide user input to one of two physically separate activation sensors (e.g., on either side of the dispenser) to indicate which of the dry or wet option they would like. Alternatively, the user may select an option, such as through a user interface and then a corresponding wet or dry sheet product may be dispensed thereafter (e.g., the user may put the sheet product dispenser in either a wet mode or a dry mode). Along these lines, in some cases, the mode of operation and/or occurrence of a dispense could be instructed by a user through their voice (e.g., through audio input). In the dry mode, the motor that drives the sheet product may operate to cause a dry sheet product dispense. In the wet mode, a pump may also activate to cause liquid (e.g., water or a wet formulation, such as including sanitizer, disinfectant, or a cleaning solution) to spray onto the sheet product prior to dispensing.

Some example sheet product dispensers, therefore, include a motor that operates to drive one or more rollers to cause sheet product to be pulled from a loaded roll of sheet product and passed through the dispenser and out of an outlet. Depending on various settings (predetermined or otherwise), a certain amount (e.g., length) of sheet product may be dispensed through the outlet.

Additionally, however, some example sheet product dispensers include a pump that operates to pull liquid from a reservoir and direct it through a spray mechanism onto the sheet product prior to dispensing (e.g., immediately prior to the outlet). Some example spray mechanisms for the sheet product dispenser include a spray bar with holes directed toward the sheet product path or multiple spray nozzles positioned along the width of the sheet product path. In some cases, one or more fluid control mechanisms (e.g., a pressure release valve) may be positioned along the fluid path to help prevent leakage of fluid from the spray mechanism and/or control when spraying of the liquid occurs (e.g., when the pressure is great enough to overcome the pressure release valve). In some embodiments, the amount of liquid applied to the sheet product may be adjusted, such as by adjusting the speed of the pump (e.g., through the level of current applied to the pump, such as to increase the flow of liquid) and/or by adjusting the speed of the movement of the sheet product along the sheet product path (e.g., the slower the sheet product passes by the spray mechanism the more liquid per area will be applied).

In some embodiments, the sheet product dispenser may be enabled to retract (e.g., "suck back" or recall) a dispensed portion of sheet product that was not removed. For example, during operation, some sheet product may remain hanging outside the outlet of the sheet product dispenser. Some embodiments of the present invention may be configured to cause the motor to operate in reverse to pull that portion of sheet product back into the dispenser housing. This helps maintain hygiene and aesthetic appearance. Notably, however, some example sheet product dispensers may be configured to disable such a retraction function after dispensing in wet mode occurs. This is because the dispensed sheet product will be wet from the liquid applied to it, and bringing the wetted sheet product back into the housing may cause unwanted effects to various components (e.g., the liquid may negatively affect performance of the rollers, motor, pump, etc.) and/or the currently stored roll of sheet product (e.g., the roll of sheet product may get wet).

Some sheet product dispensers can be configured for in-home use, providing on-demand sheet product in a user's kitchen, mud room, bathroom, or other room in their house. In this regard, some embodiments provide a sheet product dispenser that is configured to enable easy drop-in installation of perforated roll towel (PRT) (e.g., "off-the-shelf" paper towel rolls) for use with the sheet product dispenser. To achieve this, some example sheet product dispensers provide a curved surface in a loading door and an intuitive loading path for positioning the leading edge of the roll of sheet product for loading and priming of the dispenser. Further, some embodiments are configured for under-cabinet mounting and provide a downwardly-rotating loading door. In some such embodiments, multiple components may be positioned in the loading door for ease of access and visibility—such as for lending to easy replacement/refill of the liquid reservoir, easy replacement of batteries, etc. Thus, in some embodiments, one or more vein dampeners may be positioned within the housing and configured to dampen the downward rotation of the loading door to provide a pleasant user experience and prevent over-rotation or the loading door rotating downwardly too quickly (e.g., as the loading door may be heavy due to the extra components).

By providing such example sheet product dispensers that are capable of dispensing wetted or dry sheet product, a user is more able to quickly and easily acquire a sheet product dispense that is best suited for the desired job. Further, having quick access to wetted sheet product may avoid the need to utilize a separate spray bottle.

In an example embodiment, a sheet product dispenser is provided. The sheet product dispenser comprises a housing comprising a base portion and a loading door movably connected to the base portion and movable between an open position and a closed position. The loading door is configured to receive a roll of sheet product when in the open position. The housing further comprises a cavity formed by the base portion and the loading door when the loading door is in the closed position. The cavity is sized to hold the roll of sheet product therein. The housing defines a sheet product path leading from the cavity to an outlet when the loading door is in the closed position. The sheet product dispenser further includes a base portion roller positioned at least partially within the base portion; a loading door roller positioned at least partially within the loading door; and a motor configured to drive the base portion roller or the loading door roller to cause dispensing of a portion of the sheet product along the sheet product path and through the outlet of the housing. The sheet product dispenser further comprises a reservoir configured to hold liquid; a spray mechanism positioned along the sheet product path and configured to direct liquid onto the portion of the sheet product being dispensed; and a pump in fluid communication with the reservoir and the spray mechanism. The pump is configured to cause liquid from the reservoir to spray onto the portion of the sheet product through the spray mechanism prior to dispensing of the portion of the sheet product through the outlet. The sheet product dispenser further includes at least one activation sensor configured to receive user input indicating a desire to dispense the portion of the sheet product; and a controller. The controller is configured to: determine whether to operate the sheet product dispenser in either a dry mode or a wet mode based on user input provided; and either: cause the motor to operate to dispense a dry portion of the sheet product through the outlet when in the dry mode, or cause the motor to operate and the pump to operate to dispense a wetted portion of the sheet product through the outlet when in the wet mode.

In some embodiments, the controller is configured to enable a retraction function when the sheet product dispenser is in the dry mode such that a dispensed dry portion of the sheet product will be pulled back into the housing after a predetermined amount of time lapses without removal of the dispensed dry portion of the sheet product. The controller is also configured to disable the retraction function when the sheet product dispenser is in the wet mode such that a dispensed wet portion of the sheet product will not be pulled back into the housing after a predetermined amount of time lapses without removal of the dispensed wet portion of the sheet product. In some embodiments, the sheet product dispenser further comprises a leading edge sensor positioned proximate the outlet and configured to sense a leading edge of the sheet product. During operation of the retraction function, the controller is configured to operate the motor to pull the dispensed dry portion of the sheet product back into the housing until the leading edge sensor senses that there is no sheet product present.

In some embodiments, the at least one activation sensor comprises a first activation sensor and a second activation sensor. The first activation sensor is configured to sense user input indicating a desire to cause a dispense in the dry mode. The second activation sensor is configured to sense user input indicating a desire to cause a dispense in the wet mode. The controller is configured to determine whether to operate in the dry mode or the wet mode depending on which of the first activation sensor or the second activation sensor received user input. In some embodiments, the base portion defines a front surface, a first side wall, and a second side wall opposite the first side wall. The first activation sensor is positioned on the front surface proximate the first side wall and the second activation sensor is positioned on the front surface proximate the second side wall such that the first activation sensor and the second activation sensor are spaced apart on the sheet product dispenser so as to avoid accidental user input being applied to both at the same time.

In some embodiments, the controller is configured to adjust an amount of liquid applied to the portion of the sheet product based on a user setting or a user input. In some embodiments, the controller is configured to adjust a speed of operation of the motor to adjust the amount of liquid applied to the portion of the sheet product. In some embodiments, the controller is configured to adjust to a speed of operation of the pump to adjust the amount of liquid applied to the portion of the sheet product.

In some embodiments, the reservoir is configured to attach to the loading door such that the reservoir is accessible to a user when the loading door is in the open position for replacement or refilling thereof.

In some embodiments, the spray mechanism is positioned within the sheet product dispenser so as to direct liquid onto the portion of the sheet product being dispensed at a position along the sheet product path that is downstream of the loading door roller.

In some embodiments, the housing defines a mounting structure configured to enable mounting of the sheet product dispenser under a cabinet, and the loading door is configured to rotate downwardly from the base portion to the open position. In some embodiments, the loading door defines a curved surface sized to receive the roll of sheet product in a dropped-in manner when the loading door is in the open position. In some embodiments, with a leading edge of the roll of sheet product positioned over the loading door roller, the loading door is configured to be rotated to the closed position to cause the sheet product dispenser to be loaded and ready for dispensing. In some embodiments, the pump, the spray mechanism, and the motor are all positioned at least partially within the loading door, and the housing comprises a vein dampener positioned along an axis of rotation of the loading door and configured to dampen rotational movement of the loading door to the open position.

In some embodiments, the motor is configured to drive the loading door roller via a belt.

In some embodiments, the liquid is one of water or a wetted formulation including disinfectant, sanitizer, or a cleaning solution.

In some embodiments, the sheet product dispenser further comprises a fluid control mechanism in fluid communication with the pump, the reservoir, and the spray mechanism. The fluid control mechanism is positioned between the pump and the spray mechanism and configured to prevent liquid from passing through the fluid control mechanism until a predetermined amount of pressure is applied thereto such that the spray mechanism is primed with liquid but does not direct liquid onto the portion of the sheet product until the predetermined amount of pressure is applied to the fluid control mechanism. The controller is configured to operate the pump to cause application of at least the predetermined amount of pressure to the fluid control mechanism to cause the spray mechanism to direct the liquid onto the portion of the sheet product being dispensed.

In some embodiments, the spray mechanism comprises a hollow tube that includes a plurality of holes. The hollow tube is configured to receive the liquid and the plurality of holes are configured to direct the liquid toward the portion of the sheet product being dispensed.

In some embodiments, the spray mechanism comprises a plurality of nozzles that are positioned along a width of the sheet product path in a spaced apart manner. Each of the plurality of nozzles include an outlet and an impingement wall extending into a stream path of the liquid from the outlet. Each of the plurality of nozzles are configured to receive the liquid and the impingement wall of each of the plurality of nozzles is configured to split the liquid into multiple streams extending at different angles toward the portion of the sheet product.

In another example embodiment, a method for operating a sheet product dispenser is provided. The method comprises receiving, via at least one activation sensor of the sheet product dispenser, user input indicating a desire to dispense a portion of sheet product from the sheet product dispenser. The sheet product dispenser comprises a housing comprising a base portion and a loading door movably connected to the base portion and movable between an open position and a closed position. The loading door is configured to receive a roll of sheet product when in the open position. The housing further includes a cavity formed by the base portion and the loading door when the loading door is in the closed position. The cavity is sized to hold the roll of sheet product therein. The housing defines a sheet product path leading from the cavity to an outlet when the loading door is in the closed position. The sheet product dispenser further includes a base portion roller positioned at least partially within the base portion; a loading door roller positioned at least partially within the loading door; and a motor configured to drive the base portion roller or the loading door roller to cause dispensing of a portion of the sheet product along the sheet product path and through the outlet of the housing. The sheet product dispenser further includes a reservoir configured to hold liquid; a spray mechanism positioned along the sheet product path and configured to direct liquid onto the portion of the sheet product being dispensed; and a pump in fluid communication with the reservoir and the spray mechanism. The pump is configured to cause liquid from the reservoir to spray onto the portion of the sheet product through the spray mechanism prior to dispensing of the portion of the sheet product through the outlet. The at least one activation sensor configured to receive the user input. The sheet product dispenser further includes a controller. The method further includes determining, based on the user input, whether to operate the sheet product dispenser in either a dry mode or a wet mode; and either: causing the motor to operate to dispense a dry portion of the sheet product through the outlet when in the dry mode, or causing the motor to operate and the pump to operate to dispense a wetted portion of the sheet product through the outlet when in the wet mode.

In yet another example embodiment, a sheet product dispenser is provided. The sheet product dispenser comprises a housing comprising: a base portion; a cavity formed within the housing and sized to hold the roll of sheet product therein; and an outlet. The housing defines a sheet product path leading from the cavity to the outlet. The sheet product dispenser further includes a drive roller positioned at least partially within the housing and a motor configured to drive the drive roller to cause dispensing of a portion of the sheet product along the sheet product path and through the outlet of the housing. The sheet product dispenser further includes a reservoir configured to hold liquid; a spray mechanism positioned along the sheet product path and configured to direct liquid onto the portion of the sheet product being dispensed; and a pump in fluid communication with the reservoir and the spray mechanism. The pump is configured to cause liquid from the reservoir to spray onto the portion of the sheet product through the spray mechanism prior to dispensing of the portion of the sheet product through the outlet. The sheet product dispenser further includes at least one activation sensor configured to receive user input indicating a desire to dispense the portion of the sheet product and a controller. The controller is configured to: determine whether to operate the sheet product dispenser in either a dry mode or a wet mode based on user input provided; and either: cause the motor to operate to dispense a dry portion of the sheet product through the outlet when in the dry mode, or cause the motor to operate and the pump to operate to dispense a wetted portion of the sheet product through the outlet when in the wet mode.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 1:
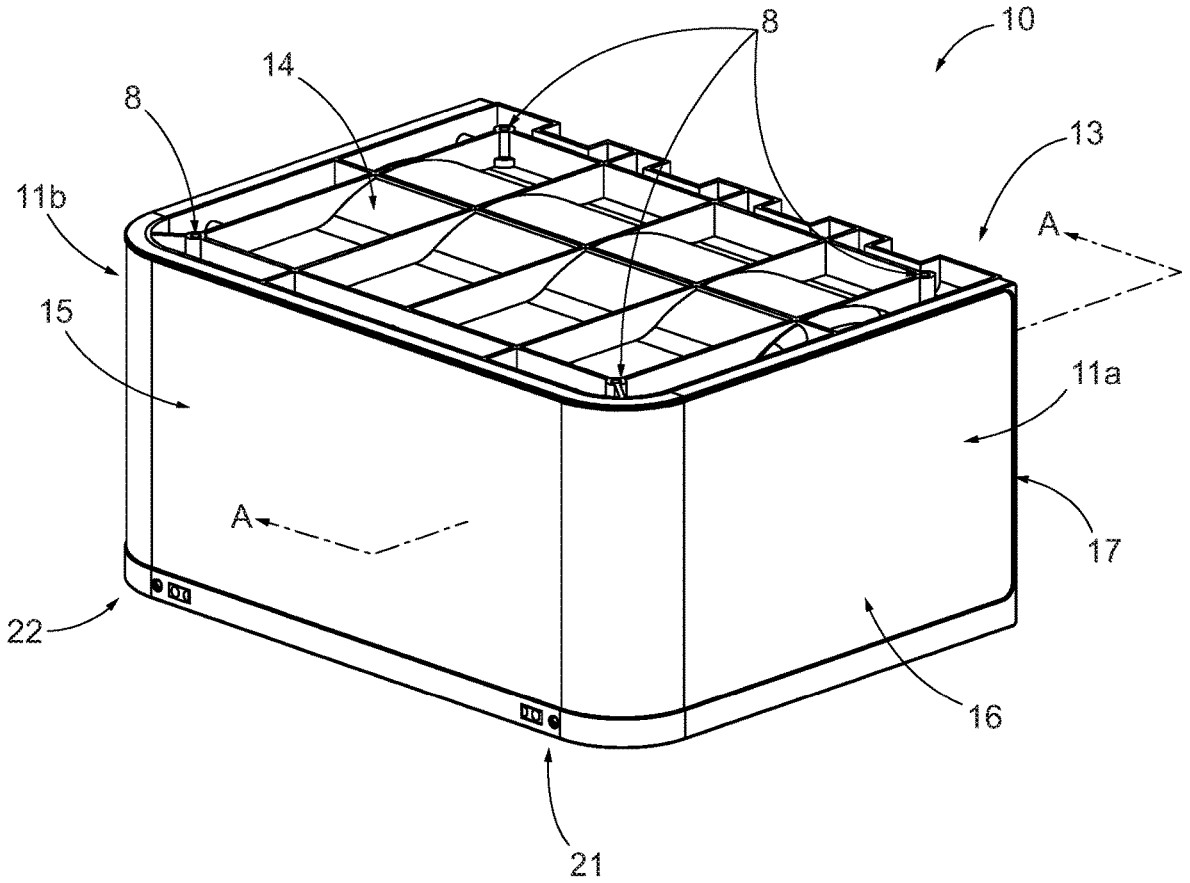
FIG. 1 shows a top perspective view of an example sheet product dispenser, in accordance with some embodiments discussed herein.
Figure 13A:
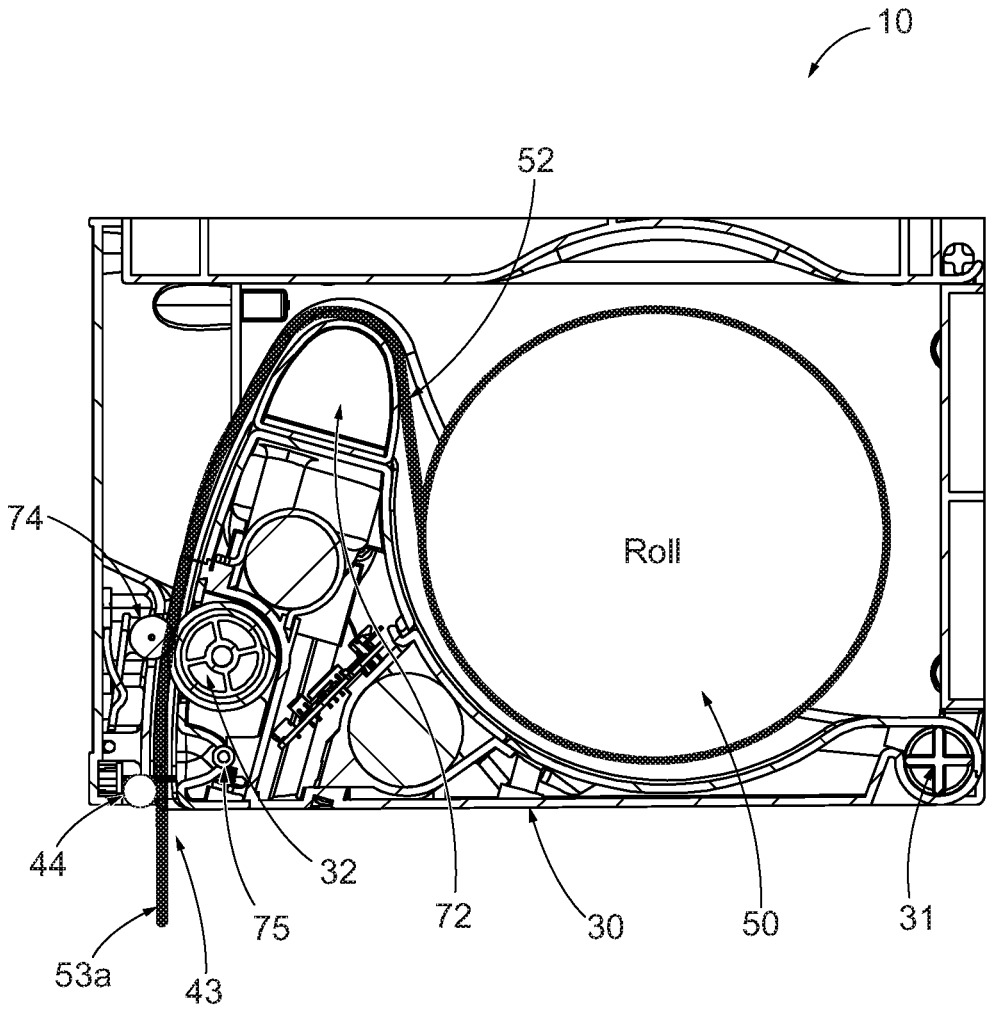
Figure 13B:
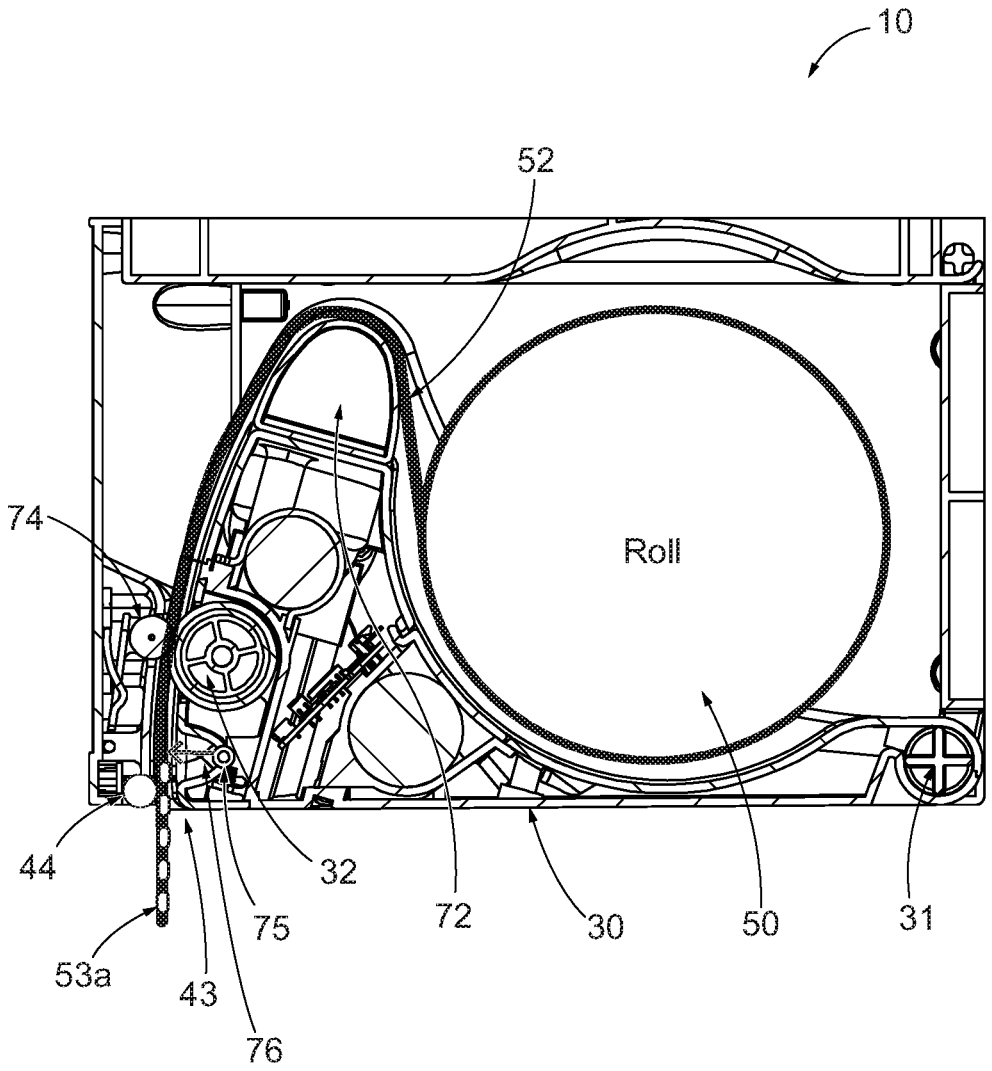
Figure 14:
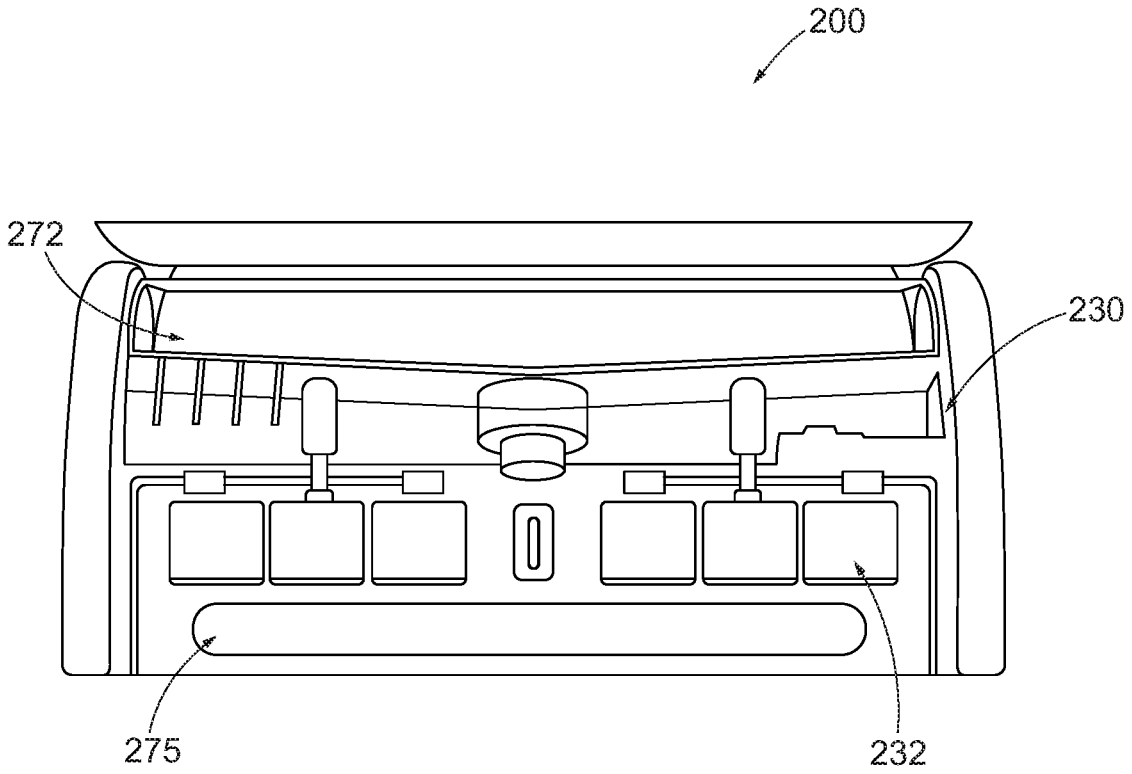
Figure 15:
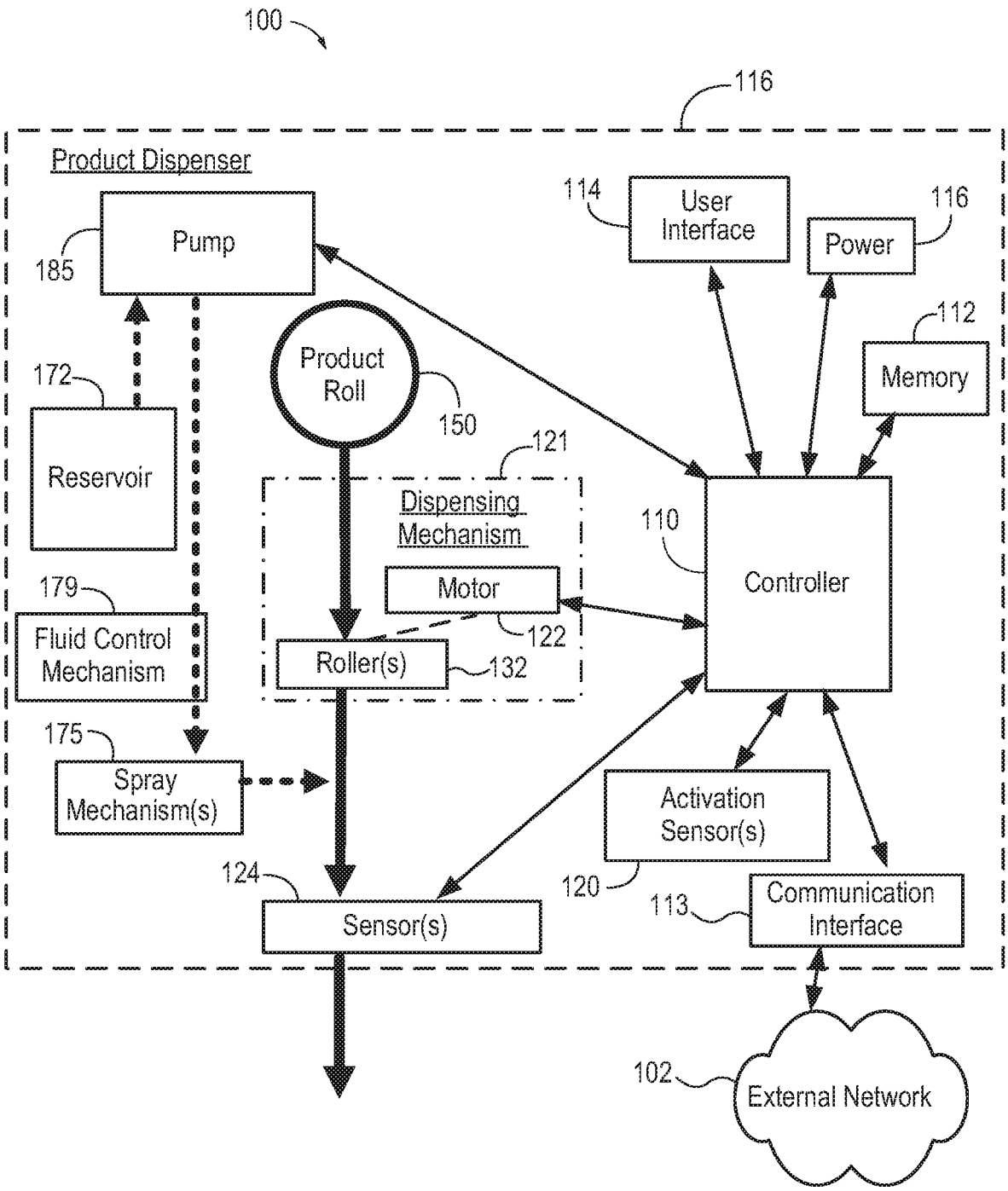
Figure 16:
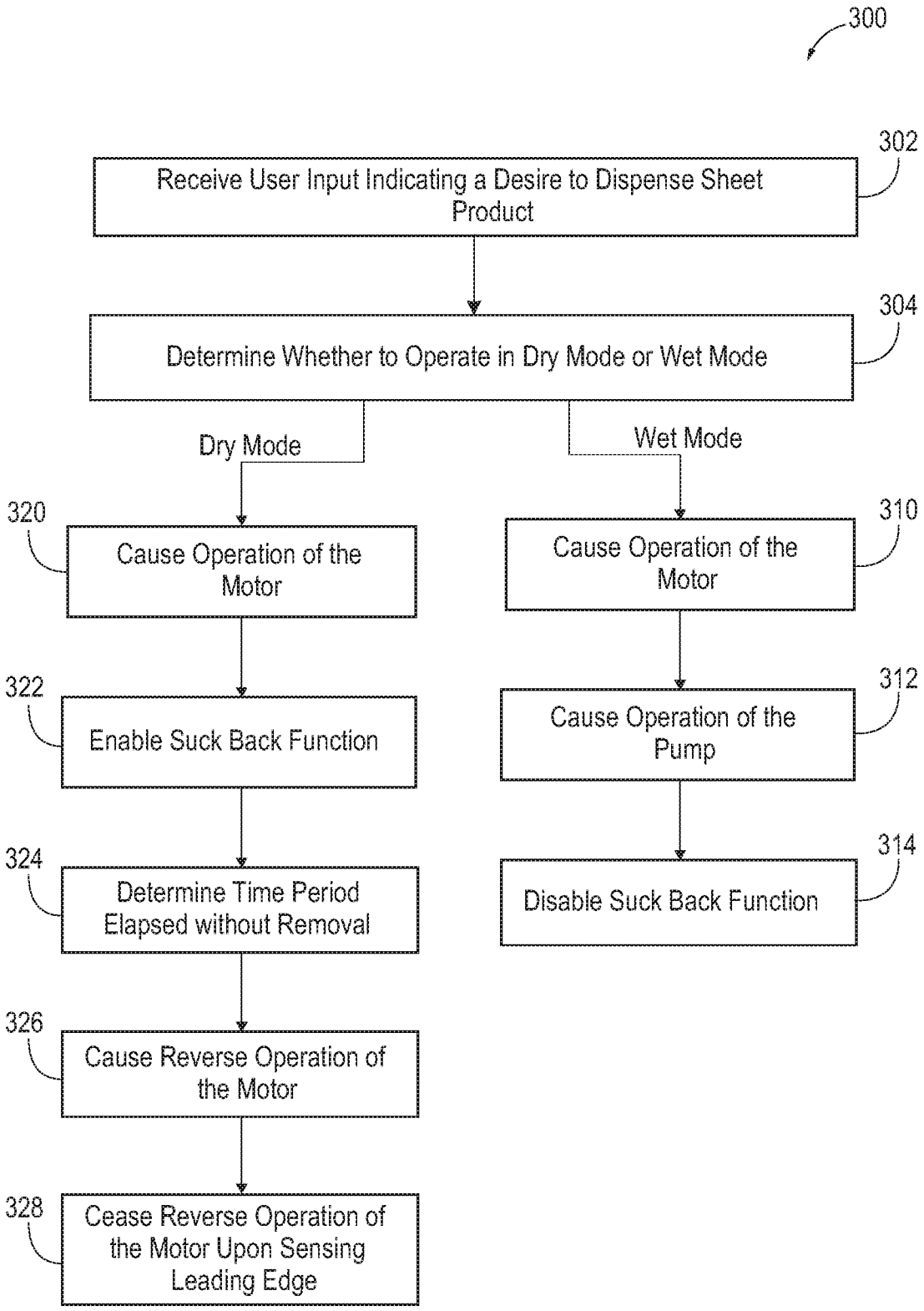

FIGS. 12A-D illustrates cross-sectional views of various example cap arrangements for example reservoirs for example sheet product dispensers, in accordance with some embodiments discussed herein;

FIG. 13A shows a cross-sectional view of the example sheet product dispenser of FIG. 1 taken along line A-A, with the sheet product loaded and being partially dispensed in a dry mode, in accordance with some embodiments discussed herein;

FIG. 13B shows a cross-sectional view of the example sheet product dispenser of FIG. 1 taken along line A-A, with the sheet product loaded and being partially dispensed in a wet mode, in accordance with some embodiments discussed herein;

FIG. 14 shows a front view of an example loading door of an example sheet product dispenser, in accordance with some embodiments discussed herein;

FIG. 15 shows a block diagram illustrating an example sheet product dispenser, in accordance with some embodiments discussed herein; and FIG. 16 illustrates a flowchart of an example method of controlling and operating an example sheet product, in accordance with some embodiments discussed herein.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout.

As used herein, a "user" of example product dispensers may be a maintainer (e.g., a maintenance person, a janitor, a facility manager, etc.) or a consumer (e.g., a person receiving a dispensed portion of the product). In some embodiments, such as for use in-home, a "user" may act as both a maintainer and a consumer.

As used herein, the term "sheet product" may include a product that is relatively thin in comparison to its length and width. Further, the sheet product may define a relatively flat, planar configuration. In some embodiments, the sheet product is flexible or bendable to permit, for example, folding, rolling, stacking, or the like. In this regard, sheet product may, in some cases, be formed into stacks or rolls for use with various embodiments described herein. Some example sheet products include towel, bath tissue, facial tissue, napkin, wipe, wrapping paper, aluminum foil, wax paper, plastic wrap, or other sheet-like products. Sheet products may be made from paper, cloth, non-woven, metallic, polymer or other materials, and in some cases may include multiple layers or plies. In some embodiments, the sheet product (such as in roll or stacked form) may be a continuous sheet that is severable or separable into individual sheets using, for example, a tear bar or cutting blade. Additionally or alternatively, the sheet product may include predefined areas of weakness, such as lines of perforations, that define individual sheets and facilitate separation and/or tearing. In some such embodiments, the lines of perforations may extend along the width of the sheet product to define individual sheets that can be torn off by a user.

As indicated herein, some embodiments of the present invention may be utilized with a sheet product dispenser. For example, certain described embodiments herein may be utilized with paper towel dispensers. In some example embodiments, paper towel dispensers may have components (e.g., roll holders, a lever, a motor, a controller, a drive roller, a pinch roller, etc.) that can be utilized to receive the supply of product (e.g., a roll of sheet product, a stack of sheet product) and facilitate dispensing from the dispenser. Additional information regarding automated and non-automated paper towel dispensers, including components and functionality thereof, can be found in U.S. Pat. Nos. 7,270,292, 5,441,189, 9,999,326, 6,871,815, each of which are assigned to the owner of the present invention and incorporated by reference in their entireties. Some example embodiments may be utilized with paper towel dispensers that are designed to utilize perforated roll towel. Example systems and functions of some such dispensers can be found in U.S. Pat. Nos. 7,887,005, 8,632,030, 9,474,422, and 9,642,503, each of which are assigned to the owner of the present invention and incorporated by reference in their entireties.

Some example embodiments herein may be utilized with tissue product dispensers. In such example embodiments, the tissue dispenser may have components (e.g., roll holders, a rotary mechanism, a motor, a controller, a drive roller, a pinch roller, etc.) that can be utilized to receive the supply of product (e.g., a roll of sheet product) and facilitate dispensing from the dispenser. Additional information regarding example tissue product dispensers, including components and functionality thereof, can be found in U.S. Pat. Nos. 8,162,252 and 7,861,964, both of which are assigned to the owner of the present invention and incorporated by reference in their entireties. Similarly, certain described embodiments herein may be utilized with napkin product dispensers. In such example embodiments, the napkin dispenser may have components (e.g., roll holders, a motor, a controller, a drive roller, a pinch roller, etc.) that can be utilized to receive the supply of product (e.g., a roll of sheet product) and facilitate dispensing from the dispenser. Additional information regarding example napkin product dispensers, including components and functionality thereof, can be found in U.S. Pat. No. 9,604,811, which is assigned to the owner of the present invention and incorporated by reference in its entirety.

Example Wetted or Dry Sheet Product Dispensers

Figure 2:
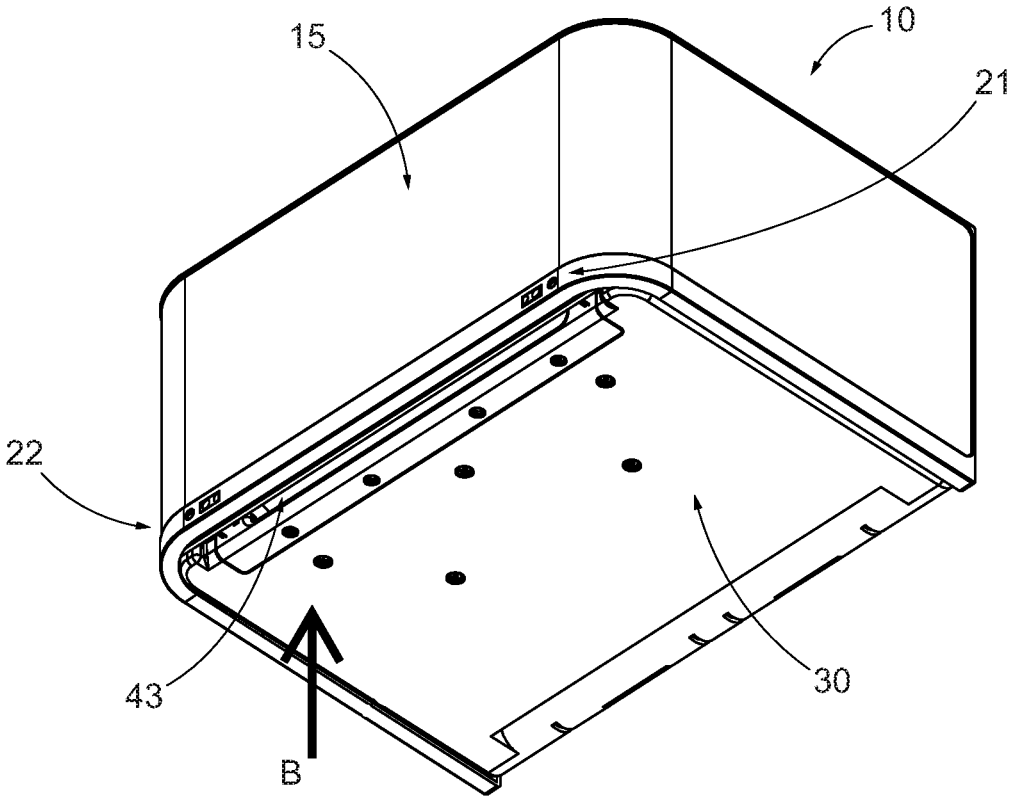
FIG. 2 shows a bottom perspective view of the example sheet product dispenser shown in FIG. 1, in accordance with some embodiments discussed herein.

FIGS. 1-2 show an example sheet product dispenser 10 according to various embodiments of the present invention. The sheet product dispenser 10 may include a housing 13 defined by a base portion 16 and a loading door 30. The base portion may be formed of multiple walls, such as a front wall 15, a back wall 17, side walls 11, and a top wall 14.

In some embodiments, the sheet product dispenser 10 may be configured to mount under a cabinet, such as in a person's home. In some such embodiments, the sheet product dispenser 10 may include one or more mounting structures 8 (e.g., screw holes, clips, attachment features, etc.) on the top wall 14 to facilitate mounting the sheet product dispenser 10 under a cabinet. Additionally or alternatively, the sheet product dispenser 10 may be configured to mount to a wall, such as through similar mounting structures located on the back wall 17.

In some embodiments, the sheet product dispenser 10 may be configured to enable dispensing of a portion of sheet product, such as in response to a user providing corresponding user input to the dispenser. For example, the sheet product dispenser 10 may include one or more activation sensors that can be utilized for providing user input indicating a desire to cause a dispense of the sheet product. In response to receiving the user input, the sheet product dispenser 10 may operate to cause a portion of the sheet product to dispense therefrom (e.g., hang down from the outlet 43). More detail regarding how the dispense occurs is described herein, such as in reference to FIGS. 13A-13B. Notably, the user input indicating the desire to dispense the portion of sheet product may be provided to any type of activation sensor/device, such as a handle, button, sensor, among others—and such an activation device may be dependent on the type of dispenser (e.g., a lever or paddle may be utilized for a non-automated sheet product dispenser). In some embodiments, the user input may be provided via touch-free user input such as may be desirable to avoid the need to touch the dispenser (e.g., the user may have dirty hands).

When dispensing the sheet product, a controller (e.g., controller 110 shown in FIG. 15) may be configured to determine and provide an amount (e.g., a length) of sheet product from the outlet. For example, the desired dispensed amount of sheet product may be pre-set (e.g., stored in memory or configured prior to the actual dispense). Additionally or alternatively, the desired dispensed amount of sheet product may be based on the user input provided. For example, a user may instruct the sheet product dispenser to provide a certain length by providing a certain input (e.g., pressing a certain button, setting the sheet length, holding their hand in front of the activation sensor for a certain amount of time, etc.).

In some embodiments, the sheet product may include pre-formed perforations that enable tearing for removal of portions of the sheet product—which thereby form pre-sized "sheets" of sheet product. In such situations, in some example embodiments, the sheet product dispenser may be configured to cause one or more pre-sized sheets to extend beyond the outlet 43 for removal by the user. Additionally or alternatively, the sheet product dispenser may include a tear bar, such as located proximate the outlet 43 and configured to enable a user to cut off a desired portion of the sheet product utilizing the tear bar.

In some embodiments, the sheet product dispenser 10 is configured to optionally provide either dry or wetted sheet product to a user. As described herein, the controller may be configured to determine which mode (e.g., wet or dry) to operate the sheet product dispenser 10 in depending on what user input is provided. For example, in the illustrated embodiment, the sheet product dispenser 10 includes a dedicated activation sensor 21 for indicating a desire to dispense dry sheet product and a separate dedicated activation sensor 22 for indicating a desire to dispense wet (or wetted) sheet product. Depending on the desired configuration, any type of activation sensor is contemplated for use with example sheet product dispensers (e.g., a capacitance sensor, infrared sensor, etc.).

As shown, in some embodiments, the dedicated activation sensors 21, 22 may be significantly spaced apart to avoid accidental triggering of the undesired activation sensor—thereby increasing the likelihood that an appropriate type (wet or dry) sheet product is dispensed. In this regard, a first activation sensor 21 is positioned on the front surface 15 proximate the first side wall 11*a* and a second activation sensor 22 is positioned on the front surface 15 proximate the second side wall 11*b* such that the first activation sensor 21 and the second activation sensor 22 are spaced apart on the sheet product dispenser 10 so as to avoid accidental user input being applied to both at the same time. Thus, when a user waves their hand in front of the first activation sensor 21 for indicating a desire to dispense dry sheet product, there is little chance that the second activation sensor 22 will pick up any unintended user input and cause an improper dispense to occur.

Although the above example details physically spaced apart activation sensors for achieving determination of which type (wet or dry) of sheet product to provide, other activation methods/devices are contemplated for enabling such a determination. For example, a user may select a mode for the sheet product dispenser to operate in (e.g., a wet mode or a dry mode)—such as by selecting an option through a user interface (e.g., screen, button, knob, etc.). Then, subsequent dispenses, such as may be indicated through an activation device/sensor, may cause sheet product to dispense in accordance with the pre-selected mode (e.g., either wet or dry). Alternatively, in some embodiments, a single activation sensor (or grouping of activation sensors) may be used to differentiate between at least two possible user input gestures—where a first user input gesture corresponds to user input indicating a desire to dispense dry sheet product and a second user input gesture corresponds to user input indicating a desire to dispense wet sheet product. For example, one wave in front of the activation sensor may indicate a desire to dispense dry sheet product, whereas two consecutive waves in front of the activation sensor may indicate a desire to dispenser wet sheet product. Likewise, a wave to the left may indicate a desire to dispense dry sheet product, while a wave to the right may indicate a desire to dispense wet sheet product. Applicant notes that any type of user input gesture is contemplated and, thus, any two different types of user input gestures that are capable of being differentiated between can be utilized. In some embodiments, the sheet product dispenser 10 may enable user configuration to set the desired user input gestures that will signal which type of sheet product to dispense.

In some embodiments, the sheet product dispenser may be enabled for audible activation, such as by recording and interpreting voice instructions from a user. For example, a user may verbally instruct the sheet product dispenser to enter one of the wet or dry modes of operation and/or cause a dispense. In some cases, the length of dispense or other options may be instructed via a user's voice. In this regard, the sheet product dispenser may include one or more components configured to enable receipt of a user's voice (e.g., microphone, recorder, etc.).

In some embodiments, additionally or alternatively, the controller may be configured to determine which mode (e.g., wet or dry) to operate the sheet product dispenser 10 in depending on other factors. For example, the controller may determine which mode to operate based on determined patterns (e.g., what was the mode of the last dispense, which mode is requested more often, the time of day, etc.). As an example, the controller may determine to operate in a dry mode immediately after operating in a wet mode such that a user receives a dry sheet product dispense immediately after receiving a wet sheet product dispense.

The housing 13, which may comprise a base portion 16 and a loading door 30, is sized to receive one or more rolls of sheet product for dispensing therefrom. For example, with reference to the partially transparent view in FIG. 7 and the cross-sectional views in FIGS. 13A and 13B, the housing 13 may define a cavity 7 sized to receive and hold a roll of sheet product 50. In this regard, the base portion 16 and the loading door 30 may form the cavity 7 when the loading door 30 is in the closed position (e.g., shown in FIGS. 1-2, 6, and 13A-13B—as well as others).

Figure 3:
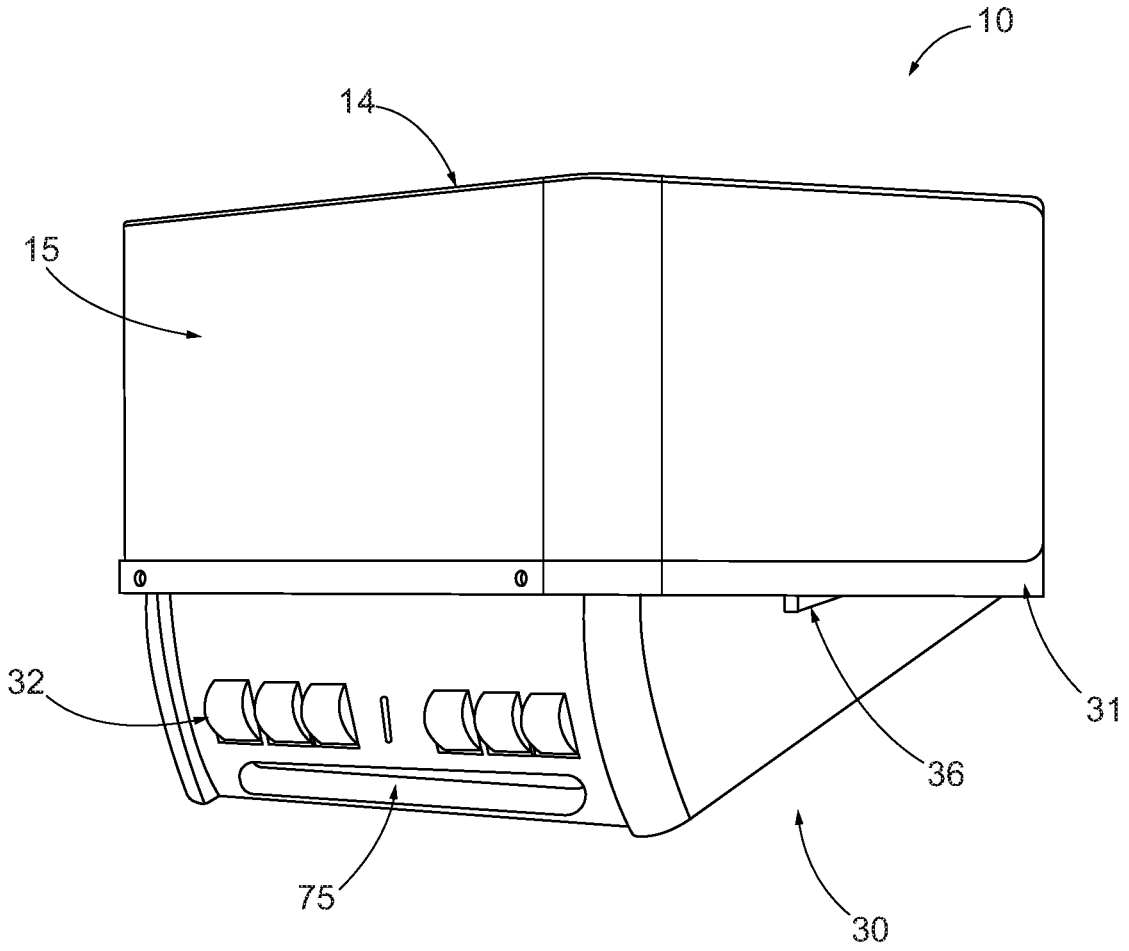
FIG. 3 shows the example sheet product dispenser of FIG. 1 with the loading door partially open, in accordance with some embodiments discussed herein.
Figure 4A:
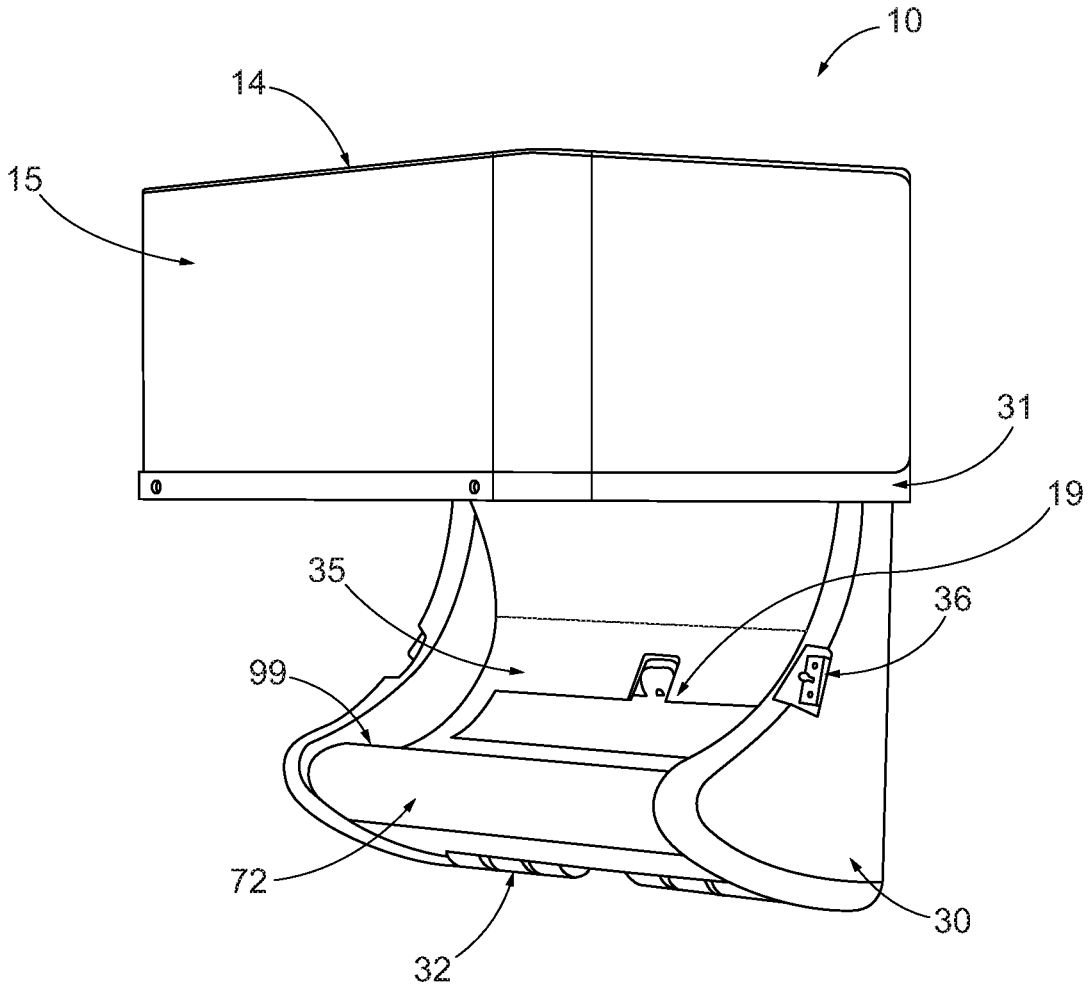
FIG. 4A shows the example sheet product dispenser of FIG. 1 with the loading door in the open position, in accordance with some embodiments discussed herein.

With reference to FIGS. 2, 3, and 4A, the loading door 30 may be configured to move between an open position (shown in FIG. 4A) and a closed position (shown in FIG. 2). In the illustrated embodiment, the loading door 30 is rotatably connected to the base portion 16, such as about axis 31. With the sheet product dispenser 10 being designed for under-cabinet mounting, the loading door 30 may rotate downwardly to an open position. For example, with reference to FIG. 2, a user may push upwardly (e.g., along arrow B) to detach a quick release mechanism 36 on the loading door 30. In the depicted embodiment, the upward movement of the quick release mechanism 36 causes a ball joint to disengage from an attachment mechanism 9 on the base portion 16 (see FIG. 7)—thereby enabling downward rotation of the loading door 30 to the open position. To close the loading door 30, the user rotates the loading door 30 back into the closed position (shown in FIG. 2) and the release mechanism 36 reengages with the attachment mechanism 9 to hold the loading door 30 in the closed position. Notably, other types of release and connection mechanisms are contemplated, as well as other rotation or movement options for opening and closing the loading door (e.g., sliding, rotating in a different direction, etc.).

Figure 7:
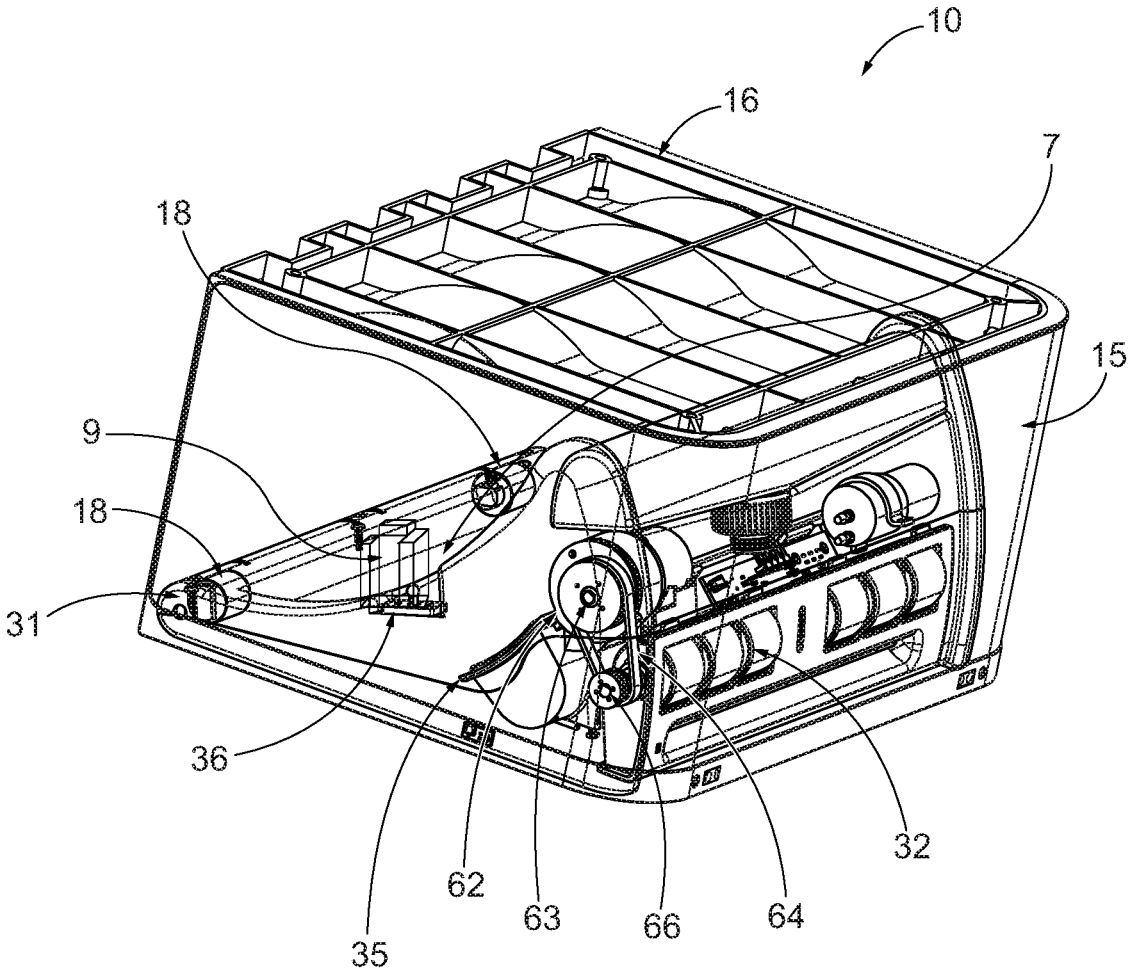
FIG. 7 shows a partially transparent view of the example sheet product dispenser of FIG. 1, in accordance with some embodiments discussed herein.
Figure 8:
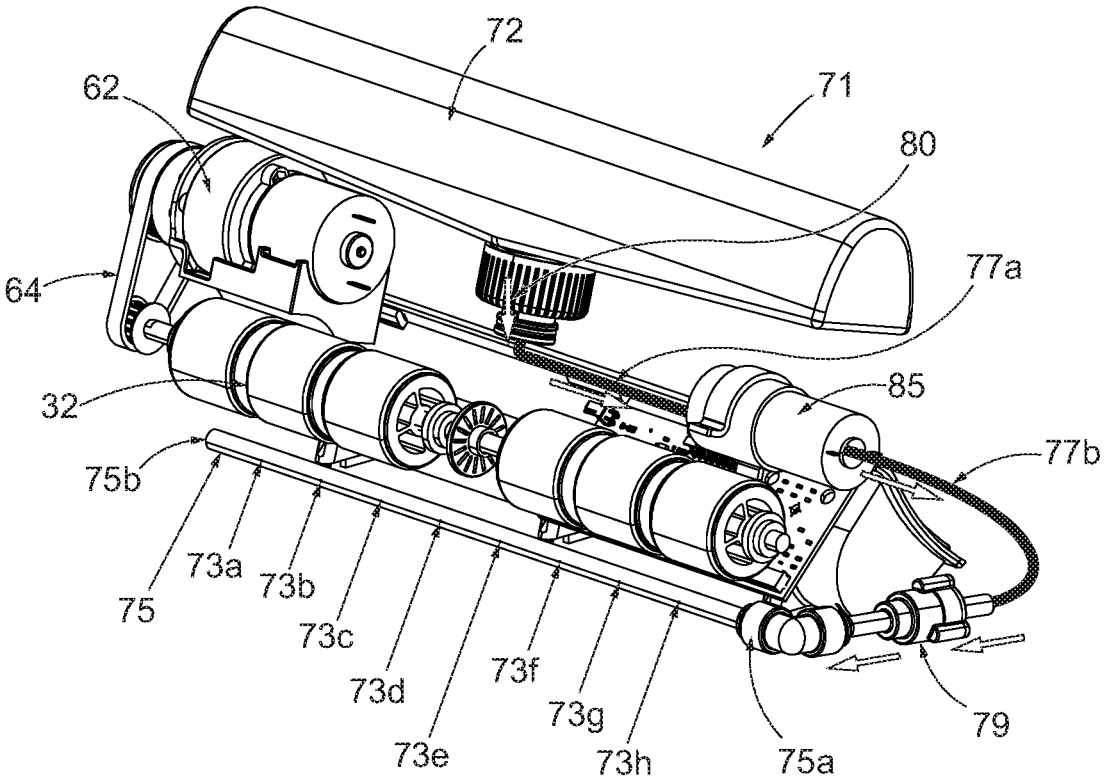
FIG. 8 shows a perspective view of some example components of an example sheet product dispenser, in accordance with some embodiments discussed herein.

As described in greater detail herein and shown in FIGS. 7-8, in some embodiments, various components of the sheet product dispenser 10, such as the motor 62, loading door rollers 32, belt 64, pump 85, reservoir 72, fluid control mechanism (e.g., pressure release valve) 79, and spray mechanism 75 are housed at least partially within the loading door 30. In this regard, the loading door 30 may have a significant weight. When the sheet product dispenser 10 is mounted under a cabinet (or the like) gravity may act on the loading door 30 after it is released from the closed position and cause the loading door 30 to rotate downwardly. In some embodiments, one or more vein dampeners 18 (shown in FIG. 7) may be provided (such as along the axis of rotation 31 of the loading door 30) to dampen, slow, and/or stop rotation of the loading door 30. In some example embodiments, the vein dampeners 18 may be configured to slow the downward rotation of the loading door 30 (which may avoid injury or an unpleasant user experience) and/or prevent the loading door 30 from over-rotating such as to hit a wall or other structure. Although the above described example embodiment employs vein dampeners, additionally or alternatively, other means to control/limit rotation/movement of the loading door could be employed, such as through one or more spring-loaded mechanisms or shock absorbing mechanisms. Notably, in some embodiments, one or more of the components may be positioned/attached in other positions or attached to other portions of the dispenser (e.g., the base portion).

Figure 5:
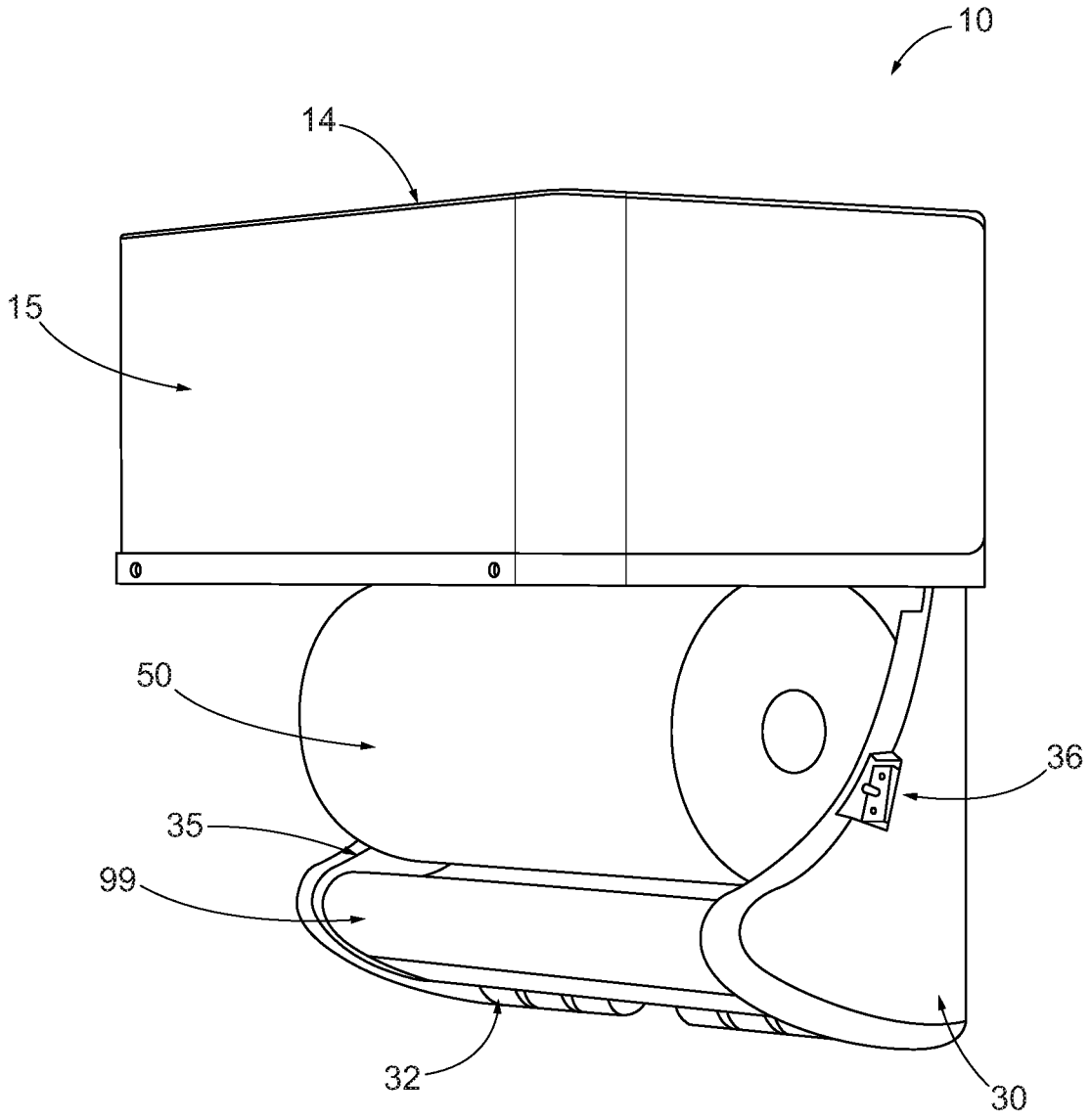
FIG. 5 shows the example sheet product dispenser of FIG. 1 with the loading door in the open position and a new roll of sheet product loaded therein, in accordance with some embodiments discussed herein.

With the loading door 30 in the open position, such as shown in FIG. 4A, a user may position (e.g., drop-in) a roll of sheet product 50 (shown in FIG. 5). In this regard, in some embodiments, the loading door 30 may define a curved surface 35 that is shaped and sized to receive and hold a roll of sheet product (such as perforated roll towel that a user can buy from their local convenience store or grocery store). Along these lines, in some embodiments, the loading door 30 (such as through its various components—e.g., the reservoir 72) may define an extended curved surface 99 (shown in FIGS. 4A and 5) that may extend underneath the roll of sheet product 50 when the roll is positioned in the curved surface 35 and the loading door 30 is in the open position (such as shown in FIG. 5) to hold it in place while the loading door 30 is in the open position. Notably, in the depicted embodiment, the extended curved surface is formed with curvature of the reservoir 72 (e.g., the sheet product may extend over the curved surface of the reservoir 72 between two side walls (e.g., marked as 39*a* and 39*b*) of the loading door 30.

Figure 6:
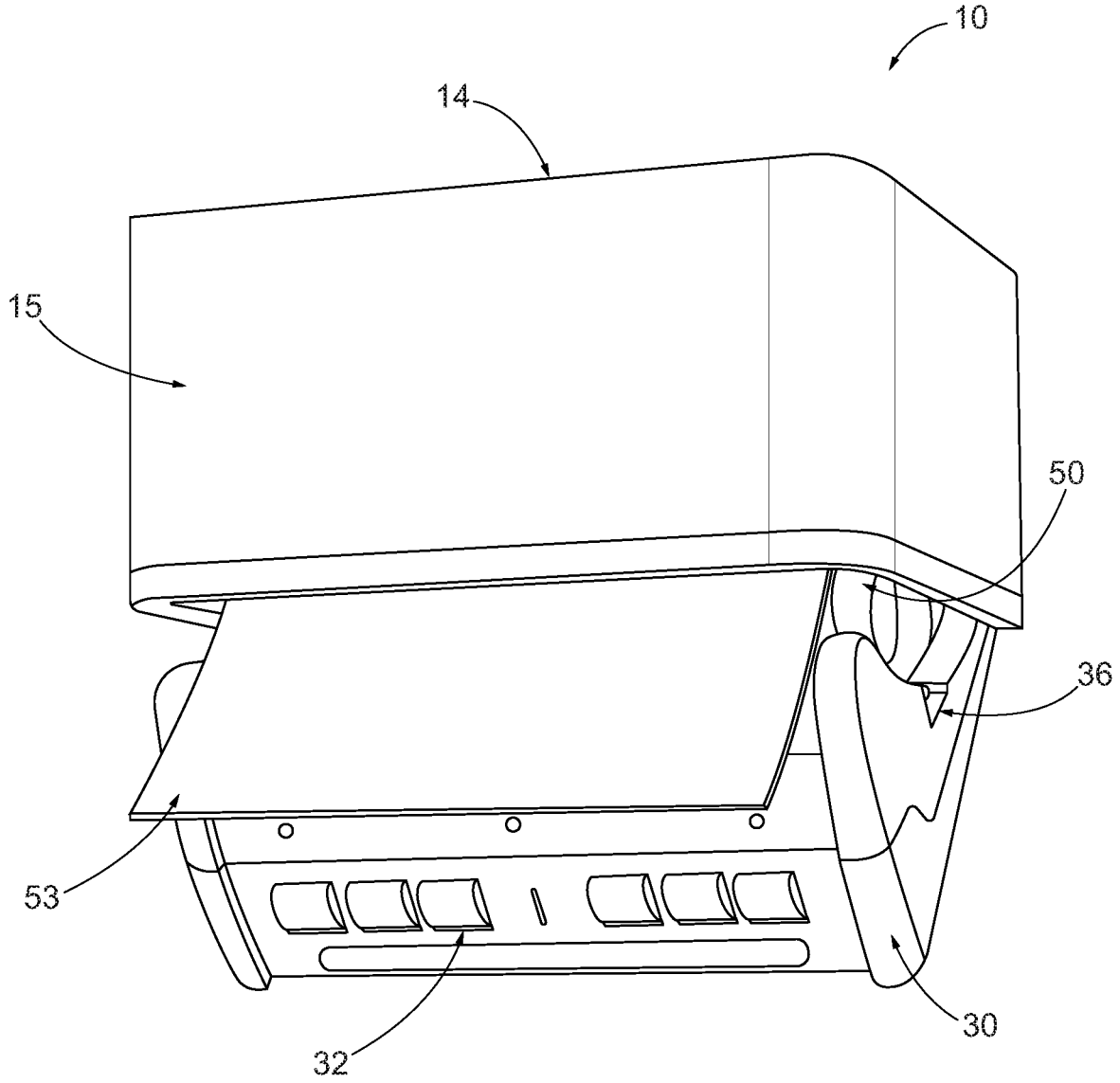
FIG. 6 shows the example sheet product dispenser of FIG. 5 with the loading door in a partially open position and a leading edge of the sheet product extending over a portion of the loading door, in accordance with some embodiments discussed herein.

With reference to FIG. 6, with the roll of sheet product 50 positioned in the loading door 30, a user can position a leading edge 53 of the roll of sheet product 50 over the extended curved surface 99 and down in front of the loading door rollers 32 and spray mechanism 75 (which are also shown in FIG. 3 and described further herein). Then, when the user closes the loading door 30, the leading edge 53 of the roll of sheet product 50 will be sandwiched between the loading door rollers 32 and corresponding base portion rollers 74 (shown in FIGS. 13A and 13B) and, thus, ready for dispensing from the sheet product dispenser 10.

The sheet product dispenser 10 also includes a motor that is configured to drive the base portion rollers and/or the loading door rollers to cause a portion of the roll of sheet product to dispense from the dispenser. With reference to FIGS. 7-8, the motor 62 may be housed in the loading door 30 and may operate to drive rotation along a motor axis 63. A drive belt 64 may communicate rotation of the motor axis 63 to a roller axis 66 to drive rotation of the loading door rollers 32 connected to the roller axis 66. In this regard, the motor 62 may control rotation of the loading door rollers 32, such as in either direction. Though the depicted embodiment shows the motor 62 set up to directly drive the loading door rollers 32, in some embodiments, the motor 62 may directly drive rotation of the base portion rollers 74 or both sets of rollers. Additionally, other types of motor operation are contemplated by some embodiments of the present invention, such as through gears, wheels, or other power transferring mechanisms.

With the sheet product loaded into the sheet product dispenser 10, the motor 62 may operate to drive rotation of the loading door rollers 32 (e.g., drive rollers) to cause the sheet product to be pulled from the roll 50 and dispensed through the outlet 43—such as due to the friction between the loading door rollers 32 and the sheet product (which is increased by the force of the base portion rollers 74 (e.g., pinch rollers)). In this regard, with reference to FIG. 13A, the sheet product may be translated along a sheet product path (e.g., generally indicated by the bold line corresponding to portions of the sheet product 52 within the dispenser 10). The sheet product path may lead from the roll of sheet product 50 over the extended curved surface 99 of the loading door 30 and back down in between the base portion rollers 74 and the loading door rollers 32 and through the outlet 43.

Returning to FIG. 4A, the sheet product dispenser 10 may be configured to utilize one or more power sources for various components described herein, such as the motor or pump. In some embodiments, the sheet product dispenser 10 may include a wall plug for receiving power from an external power source. Additionally or alternatively, the sheet product dispenser 10 may utilize one or more batteries. In some such embodiments, the loading door 30 may house the one or more batteries and may enable replacement thereof through the battery compartment 19. In the depicted embodiment, a user may access the battery compartment (such as to replace the batteries) when the loading door 30 is in the open position and the roll of sheet product is removed.

As noted herein, in some embodiments, the sheet product dispenser 10 is configured to provide wetted sheet product. In this regard, with reference to FIGS. 6 and 7, the sheet product dispenser 10 may include a fluid system 71 that includes a reservoir 72 that is configured to hold the liquid. The reservoir 72 may be in fluid communication with a spray mechanism that is configured to direct the liquid onto the sheet product as it is being dispensed from the dispenser 10. Various different liquids are contemplated by embodiments of the present invention. For example, depending on the desired characteristics, the liquid may be simply water that is used to wet the sheet product. Alternatively, a formulation could be utilized, such as adding sanitizer, cleaning solution, or disinfectant to water or other solution. In this regard, the resulting wetted sheet product may have additional benefits, such as for the sanitizing a surface that it is used to clean.

The fluid system 71 may include various components that work together to cause the sheet product being dispensed to be wetted appropriately. In some embodiments, with reference to FIG. 8, the fluid system 71 includes a reservoir 72, a pump 85, a fluid control mechanism 79, and a spray mechanism 75 (which, in the depicted embodiment, is a spray bar). One or more hoses or tubes 77*a*, 77*b* may extend between the various components and enable fluid communication therebetween.

Although the following example includes only one set of each of the components, some embodiments of the present invention contemplate the ability to include multiples of the various components (e.g., two reservoirs, such as for one or more pumps, etc.). In this regard, some embodiments contemplate including multiple reservoirs to enable selection of different formulations. Along these lines, one of the reservoirs could hold water and the other could hold a cleaning solution, and the controller may mix the two in various ranges to form a desired liquid to spray onto the sheet product (such as per the user request or a predetermined setting). In some embodiments, a user may insert a reservoir (e.g., a cartridge) into a reservoir slot in the dispenser to use to form the wetted sheet product.

The pump 85 may be in fluid communication with the reservoir 72, the fluid control mechanism 79, and the spray mechanism 75. In the depicted embodiment, a first hose 77*a* extends between the reservoir 72 and an inlet of the pump 85 and a second hose 77*b* extends from the outlet of the pump 85 to the fluid control mechanism (e.g., a pressure release valve) 79 and, ultimately, to the spray mechanism 75 (though the inlet and the outlet of the pump 85 are shown on opposite sides, they each could be positioned anywhere on the pump, such as on the same side, with the hoses extending therefrom). The pump 85 may be configured to operate to cause liquid to move from the reservoir 72 through the pump 85, past the fluid control mechanism 79, and out of the spray mechanism 75 onto the sheet product that is being dispensed (the example direction of flow of liquid from the reservoir 72 to the spray mechanism 75 is illustrated with the bold arrows). An example pump includes a diaphragm pump, which may include some advantages, such as being able to run dry without damaging the pump, being able to self-prime, and having high suction capability.

With reference to FIG. 8, when operating, the loading door 30 will be in the closed position with the reservoir 72 oriented as shown. In this regard, gravity will operate on the liquid to cause it to pass through the first hose 77*a*, through the pump 85, through the second hose 77*b*, and stop at the fluid control mechanism 79 (e.g., until enough pressure is applied, such as by operating the pump at certain speeds/levels). Notably, in a steady state (e.g., without the pump operating) there may be liquid left in the spray mechanism 75 and/or any proximate hoses (e.g., downstream of the fluid control mechanism 79). The cohesive nature of the liquid and the sizing of the holes 73*a*-73*h* of the spray mechanism 75, however, prevents that primed liquid from passing through the holes of the spray mechanism—even over the influence of gravity. In this regard, the fluid control mechanism (e.g., a pressure release valve) 79 may be configured to help prevent a sufficient amount of liquid to pass to the spray mechanism 75 that would otherwise cause the liquid to pass through the spray mechanism (and onto the sheet product if present). In the depicted embodiment, the fluid control mechanism 79 comprises a pressure release valve that acts as a gateway that prevents enough liquid from entering the spray mechanism 75 to cause spraying to occur until a sufficient amount of pressure is applied to the pressure release valve. Notably, however, other fluid control mechanisms are contemplated for controlling flow of liquid in the fluid system.

Figure 9:
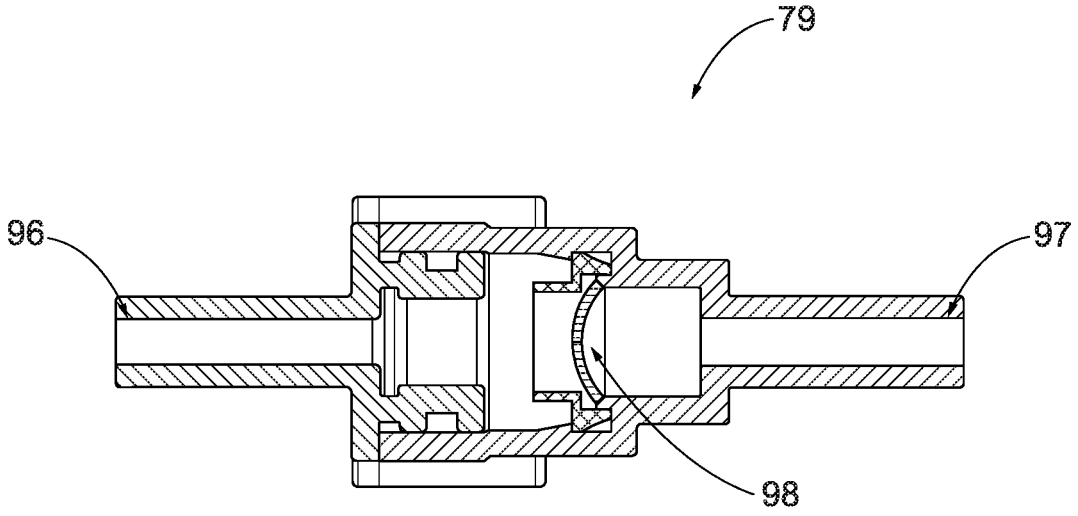
FIG. 9 illustrates a cross-sectional view of an example pressure release valve for example sheet product dispensers, in accordance with some embodiments discussed herein.

FIG. 9 illustrates a cross-sectional view of an example fluid control mechanism 79 in the form of a pressure release valve for example fluid systems 71 for the dispenser 10. For example, considering the above, liquid from the reservoir 72/pump 85 passes into the pressure release valve through the inlet 96. When the pump 85 begins to operate, enough pressure builds up to overcome the pressure valve 98 and enable a greater flow of liquid through the outlet 97 (i.e., enough liquid to force liquid through the holes in the spray mechanism 75 and onto the sheet product.

Turning to the spray mechanism(s) 75, various embodiments of the present invention contemplate any type of spray mechanism for directing liquid onto the sheet product. For example, the depicted embodiment in FIG. 8 illustrates a spray bar 75 that comprises a hollow tube that includes a plurality of holes 73*a*-73*h*. The spray bar 75 is connected at a first end 75*a* to the fluid control mechanism 79 and configured to receive liquid therefrom. However, the spray bar 75 is capped at a second 75*b* such that once enough pressure is applied, the liquid will pass out of the holes 73*a*-73*h*.

Each of the holes 73*a*-73*h* is designed to direct liquid onto a different portion along the width of the sheet product as it passes by the spray bar 75. In some embodiments, the holes 73*a*-73*h* are designed to form a straight stream of liquid that hits the sheet product and wicks outwardly in a width direction. In such an example embodiment, the holes 73*a*-73*h* may be positioned in a spaced apart manner such as at a designed distance from each other to ensure that liquid covers the intended (e.g., full) width of the sheet product as it passes out of the dispenser 10. Alternatively, the holes may be designed to create some spray pattern to cause the liquid to exit the holes at different width angles to cover a greater area in the width dimension of the sheet product.

In some embodiments, one or more of the holes could be closed to prevent liquid from exiting that specific hole, while enabling liquid to exit the other holes. In such embodiments, certain patterns of liquid spray could be created. Additionally or alternatively, the direction of the spray from the holes could be changed to create different spray patterns.

In some embodiments, the chosen spray pattern may correspond with a desired level of saturation and/or specific portions of the sheet product to be saturated. Said differently, some spray patterns may be used to saturate only a portion of the sheet product, such as leaving portions unsaturated (e.g., the edges, the middle, a portion proximate the perforations, half of the sheet product for wet/dry usage, etc.). In some embodiments, the spray mechanism could be designed to always only saturate a portion of the sheet product, such as to leave the edges unsaturated to aid in user grasping. In some embodiments, a certain width (e.g., 1 in.) may be left unsaturated on the edges of the sheet product, such as to avoid any bleed back onto other portions of the sheet product and/or to ensure that the spray mechanism is hitting the sheet product and not other portions of the dispenser.

With reference to FIG. 13B (and as shown in FIG. 3 with the loading door 30 in a partially opened position), the spray mechanism 75 may be positioned so as to direct the liquid (e.g., along arrow 76) onto sheet product that passes along the sheet product path. In particular, in some embodiments, the spray mechanism 75 may be positioned along the sheet product path downstream of the loading door rollers 32 and base portion rollers 74. Further, in some embodiments, the spray mechanism 75 may be positioned to direct the liquid onto the sheet product just prior to the sheet product exiting the dispenser 10 through the outlet 43. In such embodiments, the positioning of the spray mechanism 75 may be advantageous because it applies the liquid just before exiting the dispenser. This limits the amount of space in which the wetted sheet product passes through the dispenser, which limits any potential negative effects liquid within the dispenser could have on the various components or other portions of the stored sheet product. For example, liquid within the dispenser could cause malfunctions within various electronic components, slipping or other complications for the rollers, and other negative effects.

Figure 10:
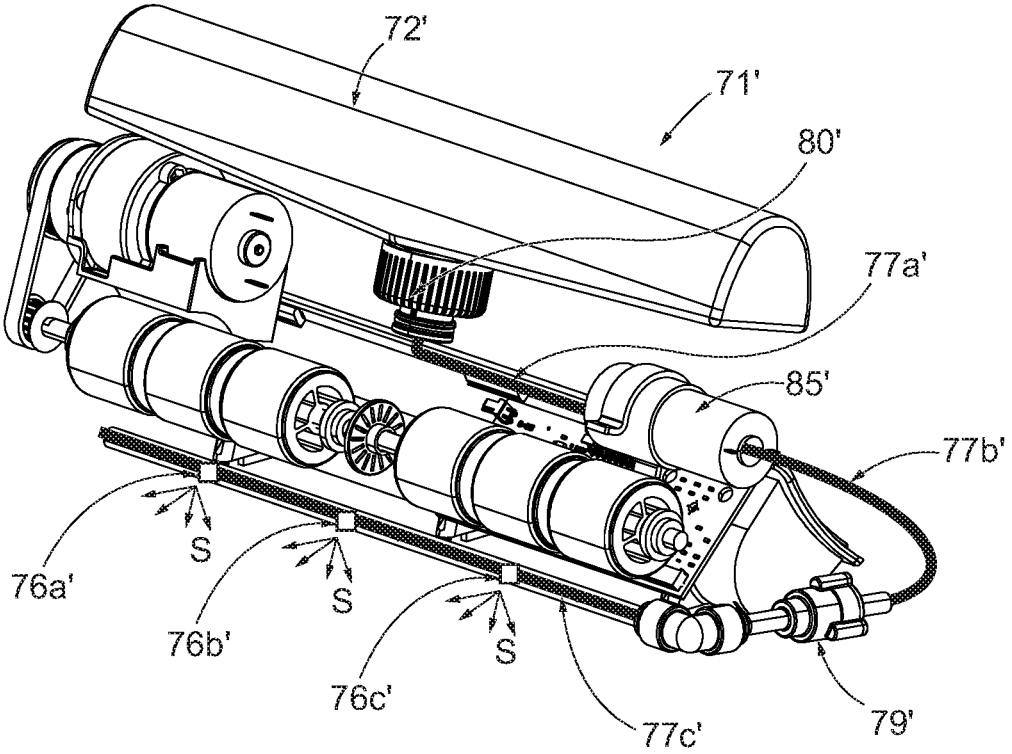
FIG. 10 shows a perspective view of some example components of an example sheet product dispenser, in accordance with some embodiments discussed herein.

FIG. 10 illustrates alternative spray mechanisms 76*a*'-76*c*' that may be utilized by various example sheet product dispensers. In the depicted embodiment, the fluid system 71' utilizes three different spray mechanisms 76*a*', 76*b*', and 76*c*'. One or more hoses 77*c*' may connect each of the spray mechanisms 76*a*'-76*c*' to the fluid control mechanism 79' (and reservoir 72'/pump 85'). Depending on the configuration of the spray mechanism, a plurality of the spray mechanisms may extend linearly along a width dimension of the sheet product that passes by. For example, each spray mechanism 76*a*'-76*c*' may form a spray pattern S that directs the liquid into multiple streams extending at different angles along the width dimension of the sheet product. In this regard, only a few spray mechanisms may be needed to cause liquid to cover the desired (e.g., full) width of the sheet product.

Figure 11:
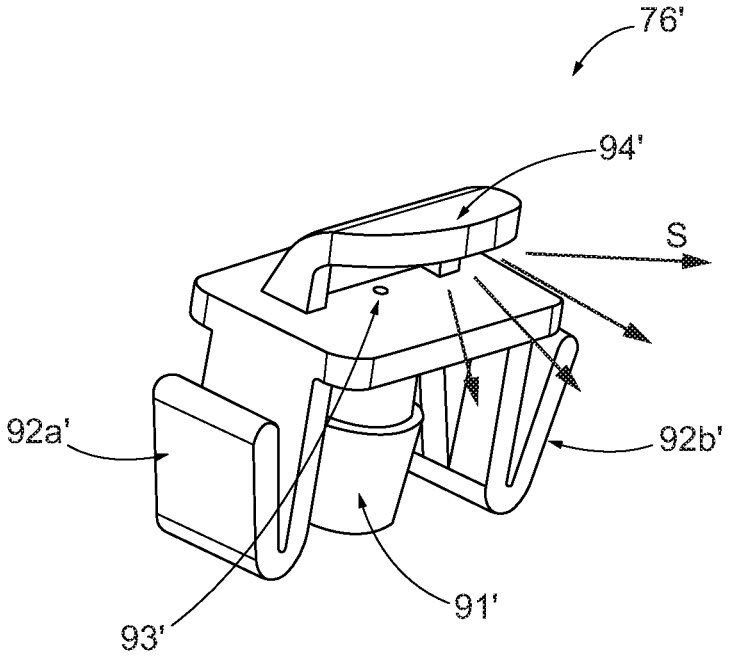
FIG. 11 shows a perspective view of an example nozzle for use with an example sheet product dispenser, in accordance with some embodiments discussed herein.

FIG. 11 shows an example spray mechanism that may be referred to as a spray nozzle 76'. The spray nozzle 76' includes an inlet 91' that may attach to and receive liquid from a hose (e.g., hose 77*c*'). In some embodiments, the spray nozzle 76' may include one or more attachment features 92*a*', 92*b*' that may enable mounting of the spray nozzle 76' to the dispenser—such that may enable the spray nozzle 76' to stay directed at an appropriate angle with respect to the sheet product path. The spray nozzle 76' may also include an outlet 93' that directs the liquid toward an impingement wall 94'. The impingement wall 94' may then redirect the liquid (e.g., at approximately 90 degrees) and cause the liquid stream to split into multiple streams that extend at different angles to create a spray pattern S that covers a greater area in the width dimension than a single stream. In some embodiments, the spray pattern may fan to about 120 degrees, thereby reducing the number of spray nozzles needed to cover the desired width of the sheet product.

Figure 4B:
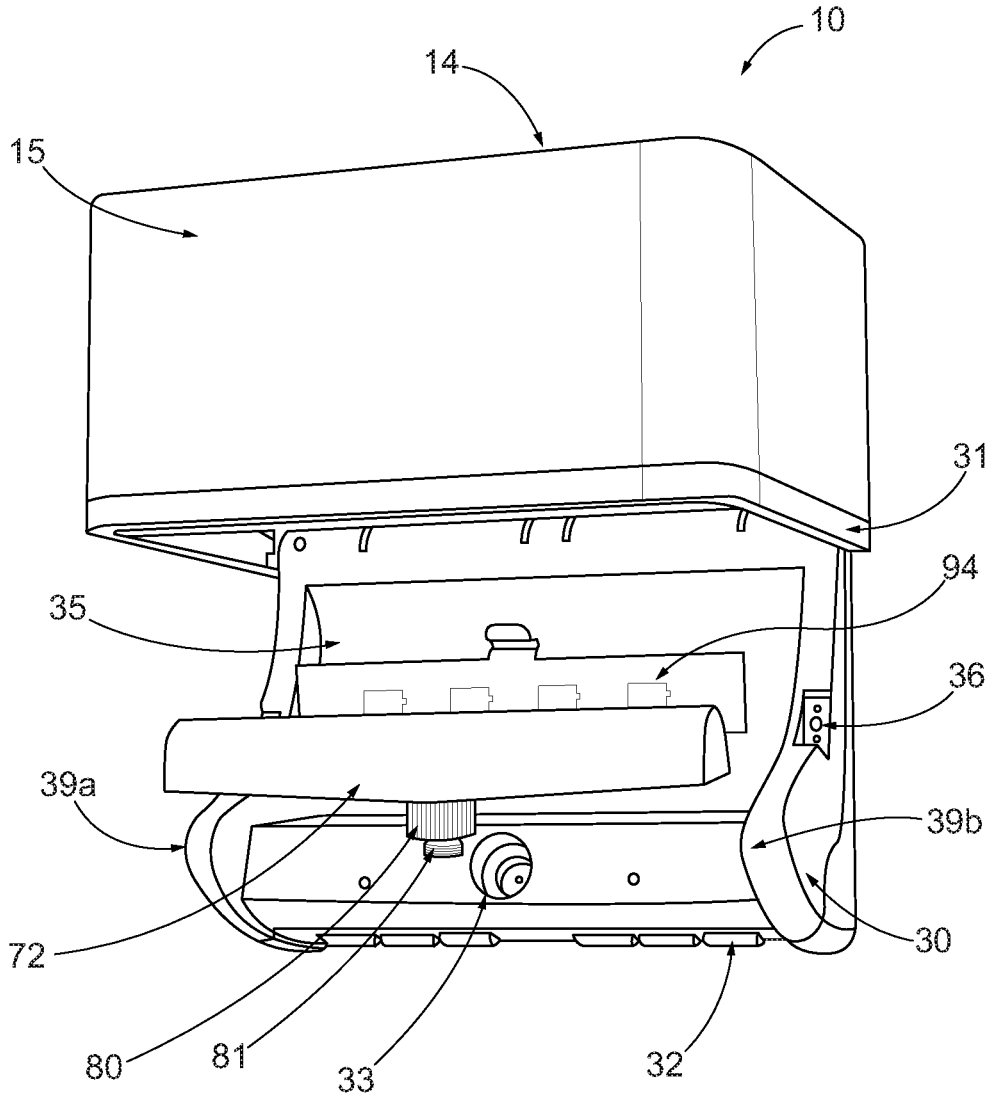
FIG. 4B shows another example sheet product dispenser with the loading door in the open position, wherein the reservoir has been detached, in accordance with some embodiments discussed herein.

With reference back to FIGS. 4A and 4B, the reservoir 72 may be viewable and/or accessible by a user upon opening the loading door 30. For example, the reservoir may be transparent or partially transparent such that a user can quickly view and ascertain the current amount of liquid remaining in the reservoir 72. Additionally or alternatively, the sheet product dispenser may be designed to enable other features for indicating the current level of liquid in the reservoir, such as through a liquid level indicator, a remote reporting, a message on a user interface, among other things. In some embodiments, that information may be conveyed with the loading door in the closed position. In some embodiments, the sheet product dispenser may include one or more sensors configured to monitor the liquid level and, then, the controller may communicate certain liquid levels to a user accordingly (e.g., through a user interface, through remote messaging, etc.).

Depending on the desired liquid level, a user may wish to replace or refill the reservoir. In this regard, depending on the configuration of the sheet product dispenser 10, the reservoir 72 and its connection to the loading door 30 and/or fluid system may dictate whether a user needs to replace an entire reservoir 72 or whether a user can open and refill the reservoir 72 (or if both are options). One potential benefit to requiring full replacement of the reservoir 72 is to control the liquid that is utilized in the dispenser (e.g., prevent a user from inserting an improper liquid into the reservoir by limiting access to provide liquid to the reservoir). Depending on the set-up, various attachment mechanisms can be utilized to releasably hold and secure the reservoir 72 in the loading door 30. For example, the cap 80 of the reservoir 72 may include an attachment structure 81 that fits within and attaches to a corresponding attachment structure 33 of the loading door 30.

Figure 12A:
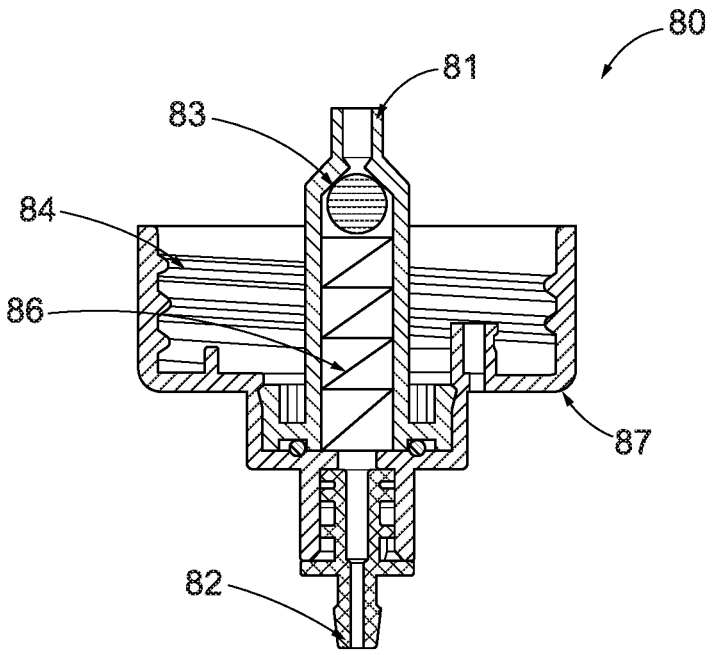
Figure 12B:
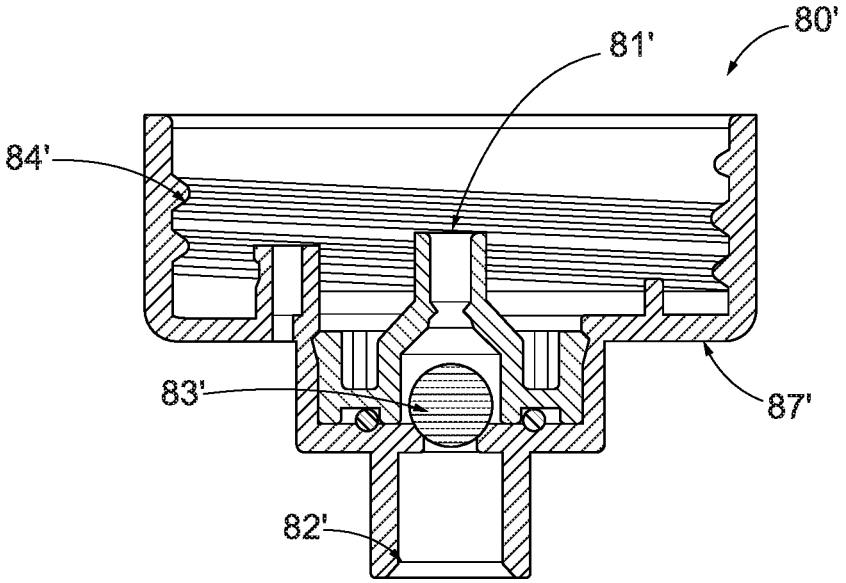
Figure 12C:
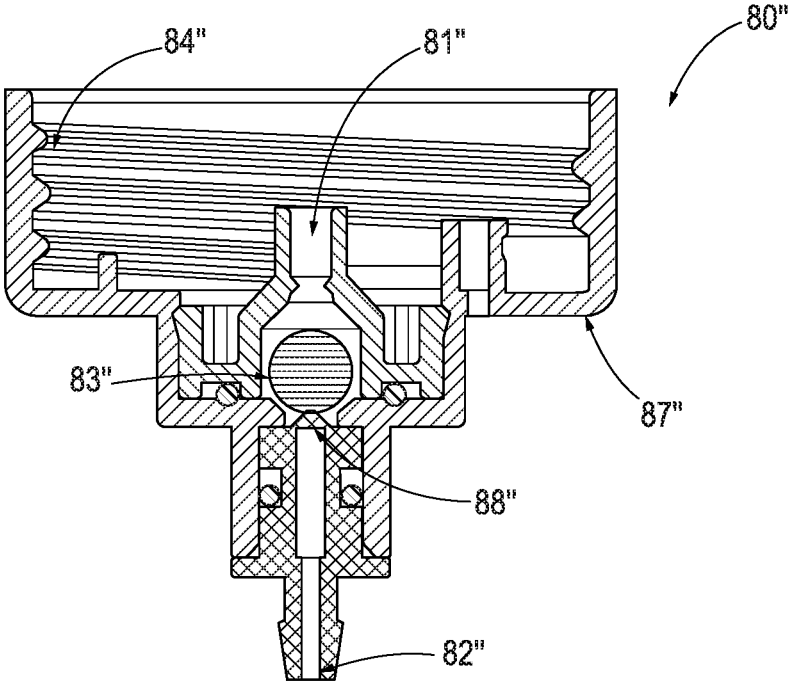
Figure 12D:
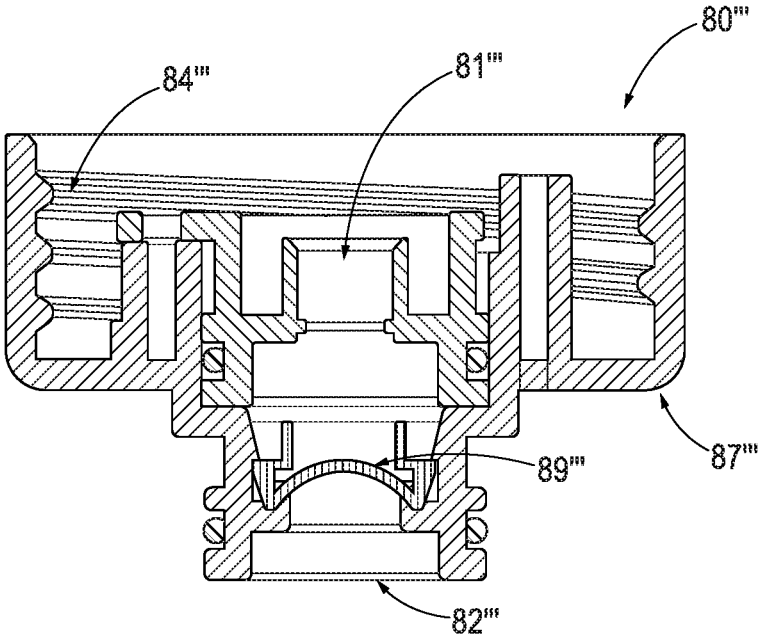

Notably, in some embodiments, the cap 80 may be designed to prevent liquid from leaking out of the reservoir 72 or cap 80 when the reservoir 72 and cap 80 are removed from the loading door 30—such as for replacement or refill. In this regard, the 80 may include one or more features to prevent the leaking from the occurring. FIGS. 12A-D illustrate some example cap arrangements that achieve such a feature. FIG. 12A illustrates a cap 80 that includes threads 84 for attachment to the reservoir 72, along with an inlet 81 and outlet 82 for directing liquid from the reservoir 72 into the fluid system. Upon detachment from the loading door, a spring 86 biases a ball 83 upwardly (when the cap 80 is inverted as shown) to engage with a corresponding shoulder to prevent liquid from leaking out of the reservoir 72. FIG. 12B illustrates another example cap 80' that includes threads 84' for attachment to the reservoir 72, along with an inlet 81' and outlet 82' for directing liquid from the reservoir 72 into the fluid system. Upon detachment from the loading door, a ball 83' falls (due to gravity) downwardly to engage with a corresponding shoulder to prevent liquid from leaking out of the reservoir 72. FIG. 12C illustrates yet another example cap 80" that includes threads 84" for attachment to the reservoir 72, along with an inlet 81" and outlet 82" for directing liquid from the reservoir 72 into the fluid system. Upon detachment from the loading door, a ball 83" falls (due to gravity) downwardly to engage with a corresponding shoulder to prevent liquid from leaking out of the reservoir 72 (notably, while shown as interacting with the ball 83'", the rib 88" only presses upwardly on the ball 83" when the cap 80" is attached to the loading door). FIG. 12D illustrates yet another example cap 80'" that includes threads 84'" for attachment to the reservoir 72, along with an inlet 81'" and outlet 82'" for directing liquid from the reservoir 72 into the fluid system. Upon detachment from the loading door, a valve 89'" closes to prevent liquid from leaking out of the reservoir 72. In some such embodiments, a relatively higher degree of pressure is required to open the pressure valve 89'" than is required to keep it open—which may be beneficial depending on the configuration of the fluid system 71.

Though the above examples of cap arrangements in FIGS. 12A-D illustrate threads for attachment to the reservoir, other forms of attachment may be contemplated, such as snaps (e.g., non-threaded annular snaps) or anti-reversing threads.

As noted herein, in some embodiments, the controller of the sheet product dispenser is configured to determine whether to operate the sheet product dispenser in a dry mode or wet mode when dispensing sheet product. In this regard, the controller will operate the various components of the sheet product dispenser 10 differently depending on which mode of operation is determined to thereby dispense either dry sheet product or wet sheet product. FIG. 13A illustrates example dispensing of dry sheet product, while FIG. 13B illustrates example dispensing of wet sheet product. In dry mode, with reference to FIG. 13A, the controller causes the motor to operate and not the pump. As such, the motor drives the loading door roller 32 to cause the sheet product to advance along the sheet product path 52 a certain distance to present a dispensed portion of dry sheet product 53*a* to a user. In wet mode, with reference to FIG. 13B, the controller causes the motor and the pump to operate. As such, the motor drives the loading door roller 32 to cause the sheet product to advance along the sheet product path 52 a certain distance. During that process, however, at an appropriate time, the controller causes the pump to operate to direct liquid onto the sheet product (e.g., along arrow 76) to cause a dispensed portion of wet sheet product 53*b* to be presented to a user.

In some embodiments, the controller may be configured to adjust the amount of liquid applied to the sheet product, such as to vary the saturation level of a dispensed wet sheet product. In some embodiments, the adjustment may be based on a user setting and/or user input (e.g., through a selection of switches, buttons, or use of a dial, such as a potentiometer dial). In some embodiments, the variations in operation may be configured based on specific formulations of the liquid or other operating parameters. As an example, the reservoir may include an identification marker, such as an RFID tag, that can be read and used to control operation of the various components of the sheet product dispenser.

In this regard, the controller may be configured to vary the speed of the pump, such as by varying the current applied to the pump, to vary the amount of liquid that passes through the spray mechanism—e.g., more liquid would mean a greater amount of saturation. Additionally or alternatively, the controller may be configured to vary the speed of operation of the motor and, thus, the speed of travel of the sheet product along the sheet product path. A change in speed may affect how much liquid is applied per area of the sheet product as it passes by the spray mechanism. For example, a slower speed of travel of the sheet product would equate to more saturation—as more liquid is applied per surface area of the sheet product.

In some embodiments, the sheet product dispenser 10 may be configured to employ a retraction function that pulls back in or rewinds up a previously dispensed portion of sheet product that was not removed by a user. For example, during operation, some sheet product may remain hanging outside the outlet of the sheet product dispenser. In some embodiments, the sheet product dispenser may sense this occurrence and cause the motor to operate in reverse to pull that portion of sheet product back into the dispenser housing. Such a feature helps maintain hygiene and aesthetic appearance. In this regard, with reference to FIG. 13A, one or more sensors 44 may be positioned to sense a leading edge of sheet product hanging from the outlet 43 of the dispenser 10. Thus, the sheet product dispenser 10 may determine whether a previously dispensed portion of sheet product is still present. After a certain (e.g., predetermined) amount of time, the controller may initiate the retraction function. In some such embodiments, the controller may operate the motor in reverse until the sensor 44 senses that there is no leading edge of the sheet product present (e.g., because the sheet product has been successfully pulled back into the dispenser housing). In some embodiments, the retraction function may be enabled after dispensing in the dry mode occurs.

Notably, however, some example sheet product dispensers may be configured to disable such a retraction function after dispensing in wet mode occurs. This is because the dispensed sheet product will be wet from the liquid applied to it, and bringing the wetted sheet product back into the housing may cause unwanted effects to various components (e.g., the liquid may negatively affect performance of the rollers, motor, pump, etc.) and/or the currently stored roll of sheet product (e.g., the roll of sheet product may get wet). In this regard, upon determining that the sheet product should operate in wet mode, the controller may disable the retraction function.

Similarly, in some embodiments, the sheet product dispenser may be configured to enable a sheet length learning sequence only in dry mode operation, as the sheet length learn sequence may require a dispensed sheet product portion to be pulled (e.g., retracted) back into the dispenser. In this regard, in some embodiments, the sheet product dispenser may be configured to employ the sheet length learn upon closing of the loading door (which may correlate to loading of a new roll of sheet product). Notably, however, that dispense could occur only in the dry mode of operation to avoid potential negative effects of retracing a wetted sheet product dispense into the housing. Example sheet length learning is described in U.S. Pat. No. 8,632,030, which is assigned to the owner of the present invention and incorporated by reference in its entirety.

FIG. 14 illustrates another example sheet product dispenser 200 that includes a transparent portion of the loading door 230. Such a transparent nature of the loading door 230 may provide for an aesthetically pleasing appearance and enable a user to view the various components of the dispenser, which may be helpful for determining the operational status of the dispenser 200 and its various components (e.g., the reservoir 272, spray bar 275, and loading door rollers 232).

Example System Architecture

A schematic representation of components of an example sheet product dispenser system 100 according to various embodiments described herein is shown in FIG. 15. It should be appreciated that the illustration in FIG. 15 is for purposes of description and that the relative size and placement of the respective components may differ. The sheet product dispenser system 100, which includes a product dispenser 116 (e.g., a sheet product dispenser according to various embodiments described herein), includes components and systems that are utilized in various embodiments described herein.

The product dispenser 116 may include many different components and/or systems (such as shown in FIG. 15), including, for example, a controller 110, a dispensing mechanism 121, a motor 122, one or more rollers 132 (e.g., loading door rollers and/or base portion rollers), a memory 112, a communication interface 113, one or more user interfaces 114, a power system 116, one or more activation sensors 120, other sensors 124 (e.g., a leading edge sensor), a pump 185, a reservoir 172, a fluid control mechanism 179 (e.g., a pressure release valve), one or more spray mechanisms 175, and other system(s)/sensor(s) such as described herein. Though shown in FIG. 15 as being a component of the product dispenser 116, such components are not required to be part of the product dispenser 116 according to various embodiments herein. For example, product dispensers of various embodiments described herein may include different components, but still function according to the desired embodiment. For example, some embodiments may include more than one product roll 150 and, in some cases, may include additional sets of components (e.g., additional reservoirs, additional dispensing mechanism, additional pumps, etc.). Similarly, in some embodiments with multiple product rolls, the product dispenser may employ a transfer mechanism (as known in the art) to enable transfer between product rolls for dispensing from a single dispensing mechanism. Along these lines, the depicted embodiment of FIG. 15 is provided for explanatory purposes and is not meant to be limiting.

As will be described in more detail herein, the controller 110 provides logic and control functionality used during operation of the product dispenser 116. Alternatively, the functionality of the controller 110 may be distributed to several controllers that each provides more limited functionality to discrete portions of the operation of product dispenser 116.

The product dispenser 116 may be configured to hold a full product rolls, such as perforated roll towel (e.g., an "off-the-shelf" roll of sheet product). For example, the depicted product dispenser 116 includes a cavity configured to receive and hold a product roll 150.

The activation sensor(s) 120 may be configured to sense/receive user input (such as a user's hand or portion thereof) indicating a desire to cause the product dispenser 105 to dispense a portion of sheet product (e.g., from the product roll 150). The activation sensor(s) 120 may be any type of sensor or feature capable of receiving user input to begin dispensing, including for example, a capacitive sensor, a light sensor, an IR sensor, a mechanical lever or button, etc. The activation sensor(s) 120 may be in communication with the controller 110 such that the controller 110 can determine when to cause dispensing of the sheet product and, as detailed herein, in which operation mode (wet or dry) to cause the dispense.

The dispensing mechanism 121 may each be configured to cause dispensing of a portion of the sheet product, such as a portion (or length) of the roll of product. Depending on the configuration, the dispensing mechanism 121 may comprise a motor 122 that drives one or more rollers 132 (e.g., the loading door rollers and/or the base portion rollers described herein). In the dispensing mechanism, a portion of the product roll may be sandwiched (e.g., in frictional contact) between a drive roller (e.g., a loading door roller) and a pinch roller (e.g., a base portion roller) such that operation/rotation of the drive roller causes dispensing of a portion of the product roll. The dispensing mechanism motor 122 may be in communication with the controller 110 such that the controller 110 may control operation of the motor 122.

The sensor(s) 124 may be positioned relative to an outlet of the sheet product dispenser 116 and configured to sense the sheet product. In some embodiments, the sensor(s) 124 may be configured to sense the leading edge of the sheet product. In some embodiments, the sensor(s) 124 may be configured to utilize IR sensing capabilities. In some embodiments, however, other types of sensors may be utilized (e.g., capacitive sensors, light sensors, mechanical sensors, etc.). The sensor(s) 124 may be in communication with the controller 110 such that the controller 110 may determine when product is present or absent. In this regard, the controller 110 may be configured to utilize the information from the sensor(s) 124 for operation of the retraction function described herein.

Although not shown in FIG. 15, the sheet product dispenser 116 may include a tear mechanism (e.g., a tear bar) for aiding in removal of the dispensed portion of sheet product. Notably, in some embodiments, the sheet product may include pre-formed perforations that can be used to tear off pre-sixed sheets without a tear bar.

As detailed herein, the sheet product dispenser 116 may include a fluid system that is configured to direct liquid onto the sheet product prior to dispensing in order to form a wetted sheet product. The fluid system may include a pump 185, a reservoir 172, a valve 179, and a spray mechanism 175 (although other components are also contemplated).

The reservoir 172 may be configured to hold liquid, such as water or a formulation (e.g., including sanitizer, cleaning solution, or disinfectant). The reservoir 172 may be in fluid communication with the pump 185, valve 179, and spray mechanism(s) 175. In some embodiments, the reservoir 172 is transparent or partially transparent to enable visual confirmation of the liquid level therein. In this regard, the reservoir 172 may be configured to be refilled and/or replaced.

The pump 185 may be in fluid communication with the reservoir 172, the valve 179, and the spray mechanism(s) 175. The pump 185 may be configured to operate to cause liquid to move from the reservoir 172 through the pump 185, past the valve 179, and out of the spray mechanism(s) 175 onto the sheet product that is being dispensed (example movement of the liquid is illustrated in dotted line arrows, whereas movement of the sheet product is illustrated in bold line arrows). Any type of liquid pump is contemplated for use with various embodiments of the present invention, such as a diaphragm pump, a metering pump, a centrifugal pump, a drum and barrel pump, a peristaltic pump, a gear pump, etc.

The valve 179 may be any type of valve useful for preventing leaking or premature spraying from occurring, such as until a sufficient amount of liquid pressure is built-up (which may be intentionally caused by the pump 185). For example, some embodiments of the present invention contemplate use of a pressure release valve.

The one or more spray mechanisms 175 may be any type of spray mechanism for directing liquid onto the sheet product. For example, some embodiments contemplate a spray bar that is formed of a hollow tube that includes a plurality of holes. Each of the holes is designed to direct liquid onto a different portion along the width of the sheet product as it passes by the spray bar. The holes may be designed to form a straight stream of liquid that hits the sheet product and wicks outwardly in a width direction as the sheet product further dispenses. Alternatively, the holes may be designed to create some spray pattern to cause the liquid to exit the holes at different width angles to cover a greater area in the width dimension of the sheet product. Other types of spray mechanisms are also contemplated, such as utilizing one or more spray nozzles that impinge on a stream of liquid to direct and spread the stream at different angles to cover more surface area of the sheet product as it passes. In some embodiments, the spray mechanism may be in direct contact with the sheet product as it passes by to eliminate the need to create a stream of liquid, which may rely more on the wicking effect of the sheet product.

The controller 110 is a suitable electronic device capable of executing dispenser functionality via hardware and/or software control, with the preferred embodiment accepting data and instructions, executing the instructions to process the data, and presenting the results. Controller 110 may accept instructions through the user interface 114, or through other means such as, but not limited to, the activation sensor(s) 120, other sensors, voice activation means, manually-operable selection and control means, radiated wavelength and electronic or electrical transfer. Therefore, the controller 110 can be, but is not limited to, a microprocessor, microcomputer, a minicomputer, an optical computer, a board computer, a complex instruction set computer, an ASIC (application specific integrated circuit), a reduced instruction set computer, an analog computer, a digital computer, a molecular computer, a quantum computer, a cellular computer, a solid-state computer, a single-board computer, a buffered computer, a computer network, a desktop computer, a laptop computer, a personal digital assistant (PDA) or a hybrid of any of the foregoing.

The controller 110 may be operably coupled with one or more components of the product dispenser 116. Such operable coupling may include, but is not limited to, solid-core wiring, twisted pair wiring, coaxial cable, fiber optic cable, mechanical, wireless, radio, and infrared. Controller 110 may be configured to provide one or more operating signals to these components and to receive data from these components. Such communication can occur using a well-known computer communications protocol such as Inter-Integrated Circuit (I2C), Serial Peripheral Interface (SPI), System Management Bus (SMBus), Transmission Control Protocol/Internet Protocol (TCP/IP), RS-232, ModBus, or any other communications protocol suitable for the purposes disclosed herein.

The controller 110 may include one or more processors coupled to a memory device 112. Controller 110 may optionally be connected to one or more input/output (I/O) controllers or data interface devices (not shown). The memory 112 may be any form of memory such as an EPROM (Erasable Programmable Read Only Memory) chip, a flash memory chip, a disk drive, or the like. As such, the memory 112 may store various data, protocols, instructions, computer program code, operational parameters, etc. In this regard, controller 110 may include operation control methods embodied in application code. These methods are embodied in computer instructions written to be executed by one or more processors, typically in the form of software. The software can be encoded in any language, including, but not limited to, machine language, assembly language, VHDL (Verilog Hardware Description Language), VHSIC HDL (Very High Speed IC Hardware Description Language), Fortran (formula translation), C, C++, Visual C++, Java, ALGOL (algorithmic language), BASIC (beginners all-purpose symbolic instruction code), visual BASIC, ActiveX, HTML (HyperText Markup Language), and any combination or derivative of at least one of the foregoing. Additionally, an operator can use an existing software application such as a spreadsheet or database and correlate various cells with the variables enumerated in the algorithms. Furthermore, the software can be independent of other software or dependent upon other software, such as in the form of integrated software.

In this regard, in some embodiments, the controller 110 may be configured to execute computer program code instructions to perform aspects of various embodiments of the present invention described herein. For example, the controller 110 may be configured to determine whether to dispense dry sheet product or wet sheet product—including causing operation of the corresponding components depending on which mode of operation the sheet product dispenser 116 will be operating in.

The user interface 114 may be configured to provide information and/or indications to a user. In some embodiments, the user interface 114 may comprise one or more light emitting diodes (LEDs) to indicate such information (e.g., low battery, dispensing is occurring, low product amount, transfer complete, etc.). In some embodiments, the user interface 114 may include a screen to display such information. In some embodiments, the user interface 114 may be configured to receive user input such as through a keypad, touchscreen, buttons, or other input device. The user interface 114 may be in communication with the controller 110 such that the controller 110 can operate the user interface 114 and/or receive instructions or information from the user interface 114.

The communication interface 113 may be configured to enable connection to external systems (e.g., an external network 102). In this manner, the controller 110 may retrieve data and/or instructions from or transmit data and/or instructions to a remote, external server via the external network 102 in addition to or as an alternative to the memory 112.

In an example embodiment, the electrical energy (e.g., power 116) for operating the product dispenser 116 may be provided by a battery, which may be comprised of one or more batteries arranged in series or in parallel to provide the desired energy. Additionally or alternatively, the power 116 may be supplied by an external power source, such as an alternating current ("AC") power source or a solar power source, or any other alternative power source as may be appropriate for an application.

The other sensor(s)/system(s) 115 may be any other type of sensors or systems that are usable in various embodiments of the present invention. Some example additional sensors or systems include a position sensor, a time sensor, a loading door opening or closing sensor, among many others.

Example Flowchart(s)

Embodiments of the present invention provide methods, apparatuses and computer program products for controlling and operating sheet product dispensers according to various embodiments described herein. Various examples of the operations performed in accordance with embodiments of the present invention will now be provided with reference to FIG. 16.

FIG. 16 illustrates a flowchart according to an example method for controlling operation of a sheet product dispenser, such as to provide a dispense of either dry sheet product or wet sheet product according to an example embodiment 300. The operations illustrated in and described with respect to FIG. 16 may, for example, be performed by, with the assistance of, and/or under the control of one or more of the controller 110, memory 112, communication interface 113, user interface 114, activation sensor(s) 120, dispensing mechanism 121, motor 122, roller(s) 132, sensor (s) 124, pump 185, valve 179, spray mechanism(s) 175, and/or other sensor(s)/system(s) of the sheet product dispenser 116.

Operation 302 may comprise receiving user input indicating that the user desires occurrence of a dispense of sheet product. The activation sensor(s) 120, controller 110, memory 112, communication interface 113, and/or user interface 114 may, for example, provide means for performing operation 302. Operation 304 may comprise determining whether to operate the dispenser in wet mode or dry mode. The activation sensor(s) 120, controller 110, memory 112, communication interface 113, and/or user interface 114 may, for example, provide means for performing operation 304.

If it is determined that the dispenser should operate in wet mode, then operation 310 may comprise causing operation of the motor to cause dispensing of the sheet product. The controller 110, memory 112, communication interface 113, dispensing mechanism 121, motor 122, and/or rollers 132 may, for example, provide means for performing operation 310. Around the same time, operation 312 may comprise causing operation of the pump to cause liquid to be directed onto the sheet product as it is being dispensed. The controller 110, memory 112, communication interface 113, pump 185, reservoir 172, valve 179, and/or spray mechanism(s) 175 may, for example, provide means for performing operation 312. Operation 314 may comprise disabling the retraction function to prevent a wetted sheet product portion from being pulled back into the dispenser. The controller 110, memory 112, communication interface 113, dispensing mechanism 121, and/or motor 122 may, for example, provide means for performing operation 314.

If it is determined that the dispenser should operate in dry mode, then operation 320 may comprise causing operation of the motor to cause dispensing of the sheet product. The controller 110, memory 112, communication interface 113, dispensing mechanism 121, motor 122, and/or rollers 132 may, for example, provide means for performing operation 320. Operation 322 may comprise enabling the retraction function such that sheet product hanging from the dispenser for a certain period of time may be pulled back into the dispenser. The controller 110, memory 112, communication interface 113, dispensing mechanism 121, and/or motor 122 may, for example, provide means for performing operation 322. Operation 324 may comprise determining that the certain amount of time has elapsed without removal of the previously dispensed sheet product portion. The controller 110, memory 112, communication interface 113, sensor(s) 124, dispensing mechanism 121, and/or motor 122 may, for example, provide means for performing operation 324. If the time period has elapsed and the previously dispensed sheet product remains, then operation 326 may comprise causing operation of the motor in reverse to cause the previously dispensed sheet product to be pulled back into the dispenser. The controller 110, memory 112, communication interface 113, dispensing mechanism 121, motor 122, and/or rollers 132 may, for example, provide means for performing operation 326. Finally, operation 328 may comprise ceasing operation of the motor in reverse once the previously dispensed sheet product has been successfully pulled back into the dispenser. The controller 110, memory 112, communication interface 113, sensor(s) 124, dispensing mechanism 121, motor 122, and/or rollers 132 may, for example, provide means for performing operation 328.

FIG. 16 illustrate an example flowchart of a system, method, and computer program product according to various example embodiments described herein. It will be understood that each block of the flowcharts, and combinations of blocks in the flowcharts, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by, for example, the memory 112 and executed by, for example, the controller 110. As will be appreciated, any such computer program product may be loaded onto a computer or other programmable apparatus, such that the computer program product including the instructions which execute on the computer or other programmable apparatus creates means for implementing the functions specified in the flowcharts block(s). Further, the computer program product may comprise one or more non-transitory computer-readable mediums on which the computer program instructions may be stored such that the one or more computer-readable memories can direct a computer or other programmable device to cause a series of operations to be performed on the computer or other programmable apparatus to produce a computer-implemented process such that the instructions which execute on the computer or other programmable apparatus implement the functions specified in the flowcharts block(s).

Associated systems and methods for manufacturing example product dispensers described herein are also contemplated by some embodiments of the present invention.

CONCLUSION

Many modifications and other embodiments of the inventions set forth herein may come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A method for operating a sheet product dispenser, the method comprising:

receiving, via at least one activation sensor of the sheet product dispenser, user input indicating a desire to dispense a portion of sheet product from the sheet product dispenser, wherein the sheet product dispenser comprises:

a housing comprising:

a base portion; and a loading door movably connected to the base portion and movable between an open position and a closed position, wherein the loading door is configured to receive a roll of sheet product when in the open position; and a cavity formed by the base portion and the loading door when the loading door is in the closed position, wherein the cavity is sized to hold the roll of sheet product therein, wherein the housing defines a sheet product path leading from the cavity to an outlet when the loading door is in the closed position;

a base portion roller positioned at least partially within the base portion;

a loading door roller positioned at least partially within the loading door, wherein, when the loading door is in the closed position, the loading door roller and the base portion roller are configured to sandwich sheet product from the roll of sheet product therebetween for dispensing of the sheet product;

a motor configured to drive the base portion roller or the loading door roller to cause dispensing of a portion of the sheet product along the sheet product path and through the outlet of the housing;

a reservoir configured to hold liquid;

a spray mechanism positioned along the sheet product path and configured to direct liquid onto the portion of the sheet product being dispensed;

a pump in fluid communication with the reservoir and the spray mechanism, wherein the pump is configured to cause liquid from the reservoir to spray onto the portion of the sheet product through the spray mechanism prior to dispensing of the portion of the sheet product through the outlet;

the at least one activation sensor configured to receive the user input; and a controller;

determining, based on the user input, whether to operate the sheet product dispenser in either a dry mode or a wet mode; and either:

causing the motor to operate to dispense a dry portion of the sheet product through the outlet when in the dry mode, or causing the motor to operate and the pump to operate to dispense a wetted portion of the sheet product through the outlet when in the wet mode.

2. A sheet product dispenser comprising:

a housing comprising:

a base portion;

a loading door movably connected to the base portion and movable between an open position and a closed position, wherein the loading door is configured to receive a roll of sheet product when in the open position; and a cavity formed by the base portion and the loading door when the loading door is in the closed position, wherein the cavity is sized to hold the roll of sheet product therein, wherein the housing defines a sheet product path leading from the cavity to an outlet when the loading door is in the closed position;

a base portion roller positioned at least partially within the base portion;

a loading door roller positioned at least partially within the loading door, wherein, when the loading door is in the closed position, the loading door roller and the base portion roller are configured to maintain frictional contact with sheet product from the roll of sheet product therebetween for dispensing of the sheet product;

a motor configured to drive the base portion roller or the loading door roller to cause dispensing of a portion of the sheet product along the sheet product path and through the outlet of the housing;

a reservoir configured to hold liquid;

a spray mechanism positioned along the sheet product path and configured to direct liquid onto the portion of the sheet product being dispensed;

a pump in fluid communication with the reservoir and the spray mechanism, wherein the pump is configured to cause liquid from the reservoir to spray onto the portion of the sheet product through the spray mechanism prior to dispensing of the portion of the sheet product through the outlet;

at least one activation sensor configured to receive user input indicating a desire to dispense the portion of the sheet product; and a controller configured to:

determine whether to operate the sheet product dispenser in either a dry mode or a wet mode based on user input provided; and either:

cause the motor to operate to dispense a dry portion of the sheet product through the outlet when in the dry mode, or cause the motor to operate and the pump to operate to dispense a wetted portion of the sheet product through the outlet when in the wet mode.

3. The sheet product dispenser of claim 2, wherein the controller is configured to:

enable a retraction function when the sheet product dispenser is in the dry mode such that a dispensed dry portion of the sheet product will be pulled back into the housing after a predetermined amount of time lapses without removal of the dispensed dry portion of the sheet product; and disable the retraction function when the sheet product dispenser is in the wet mode such that a dispensed wet portion of the sheet product will not be pulled back into the housing after a predetermined amount of time lapses without removal of the dispensed wet portion of the sheet product.

4. The sheet product dispenser of claim 3 further comprising a leading edge sensor positioned proximate the outlet and configured to sense a leading edge of the sheet product, wherein, during operation of the retraction function, the controller is configured to operate the motor to pull the dispensed dry portion of the sheet product back into the housing until the leading edge sensor senses that there is no sheet product present.

5. The sheet product dispenser of claim 2, wherein the at least one activation sensor comprises a first activation sensor and a second activation sensor, wherein the first activation sensor is configured to sense user input indicating a desire to cause a dispense in the dry mode, wherein the second activation sensor is configured to sense user input indicating a desire to cause a dispense in the wet mode, and wherein the controller is configured to determine whether to operate in the dry mode or the wet mode depending on which of the first activation sensor or the second activation sensor received user input.

6. The sheet product dispenser of claim 5, wherein the base portion defines a front surface, a first side wall, and a second side wall opposite the first side wall, wherein the first activation sensor is positioned on the front surface proximate the first side wall and the second activation sensor is positioned on the front surface proximate the second side wall such that the first activation sensor and the second activation sensor are spaced apart on the sheet product dispenser so as to avoid accidental user input being applied to both at the same time.

7. The sheet product dispenser of claim 2, wherein the controller is configured to adjust an amount of liquid applied to the portion of the sheet product based on a user setting or a user input.

8. The sheet product dispenser of claim 7, wherein the controller is configured to adjust a speed of operation of the motor to adjust the amount of liquid applied to the portion of the sheet product.

9. The sheet product dispenser of claim 7, wherein the controller is configured to adjust to a speed of operation of the pump to adjust the amount of liquid applied to the portion of the sheet product.

10. The sheet product dispenser of claim 2, wherein the reservoir is configured to attach to the loading door such that the reservoir is accessible to a user when the loading door is in the open position for replacement or refilling thereof.

11. The sheet product dispenser of claim 2, wherein the spray mechanism is positioned within the sheet product dispenser so as to direct liquid onto the portion of the sheet product being dispensed at a position along the sheet product path that is downstream of the loading door roller.

12. The sheet product dispenser of claim 2, wherein the housing defines a mounting structure configured to enable mounting of the sheet product dispenser under a cabinet, and wherein the loading door is configured to rotate downwardly from the base portion to the open position.

13. The sheet product dispenser of claim 12, wherein the loading door defines a curved surface sized to receive the roll of sheet product in a dropped-in manner when the loading door is in the open position.

14. The sheet product dispenser of claim 13, wherein, with a leading edge of the roll of sheet product positioned over the loading door roller, the loading door is configured to be rotated to the closed position to cause the sheet product dispenser to be loaded and ready for dispensing.

15. The sheet product dispenser of claim 12, wherein the pump, the spray mechanism, and the motor are all positioned at least partially within the loading door, and wherein the housing comprises a vein dampener positioned along an axis of rotation of the loading door and configured to dampen rotational movement of the loading door to the open position.

16. The sheet product dispenser of claim 2, wherein the motor is configured to drive the loading door roller via a belt.

17. The sheet product dispenser of claim 2, wherein the liquid is one of water or a wetted formulation including disinfectant, sanitizer, or a cleaning solution.

18. The sheet product dispenser of claim 2 further comprising a fluid control mechanism in fluid communication with the pump, the reservoir, and the spray mechanism, wherein the fluid control mechanism is positioned between the pump and the spray mechanism and configured to prevent liquid from passing through the fluid control mechanism until a predetermined amount of pressure is applied thereto such that the spray mechanism is primed with liquid but does not direct liquid onto the portion of the sheet product until the predetermined amount of pressure is applied to the fluid control mechanism, and wherein the controller is configured to operate the pump to cause application of at least the predetermined amount of pressure to the fluid control mechanism to cause the spray mechanism to direct the liquid onto the portion of the sheet product being dispensed.

19. The sheet product dispenser of claim 2, wherein the spray mechanism comprises a hollow tube that includes a plurality of holes, wherein the hollow tube is configured to receive the liquid and the plurality of holes are configured to direct the liquid toward the portion of the sheet product being dispensed.

20. The sheet product dispenser of claim 2, wherein the spray mechanism comprises a plurality of nozzles that are positioned along a width of the sheet product path in a spaced apart manner, wherein each of the plurality of nozzles include an outlet and an impingement wall extending into a stream path of the liquid from the outlet, wherein each of the plurality of nozzles are configured to receive the liquid and the impingement wall of each of the plurality of nozzles is configured to split the liquid into multiple streams extending at different angles toward the portion of the sheet product.

21. A sheet product dispenser comprising:

a housing comprising:
- a base portion;
- a cavity formed within the housing and sized to hold a roll of sheet product therein; and
- an outlet;
- wherein the housing defines a sheet product path leading from the cavity to the outlet;

a drive roller positioned at least partially within the housing;

a motor configured to drive the drive roller to cause dispensing of a portion of the sheet product along the sheet product path and through the outlet of the housing;

a reservoir configured to hold liquid;

a spray mechanism positioned along the sheet product path and configured to direct liquid onto the portion of the sheet product being dispensed;

a pump in fluid communication with the reservoir and the spray mechanism, wherein the pump is configured to cause liquid from the reservoir to spray onto the portion of the sheet product through the spray mechanism prior to dispensing of the portion of the sheet product through the outlet;

at least one activation sensor configured to receive user input indicating a desire to dispense the portion of the sheet product; and a controller configured to:
- determine whether to operate the sheet product dispenser in either a dry mode or a wet mode based on user input provided;
- either:
  - cause the motor to operate to dispense a dry portion of the sheet product through the outlet when in the dry mode, or
  - cause the motor to operate and the pump to operate to dispense a wetted portion of the sheet product through the outlet when in the wet mode;
- enable a retraction function when the sheet product dispenser is in the dry mode such that a dispensed dry portion of the sheet product will be pulled back into the housing after a predetermined amount of time lapses without removal of the dispensed dry portion of the sheet product and
- disable the retraction function when the sheet product dispenser is in the wet mode such that a dispensed wet portion of the sheet product will not be pulled back into the housing after a predetermined amount of time lapses without removal of the dispensed wet portion of the sheet product.

* * * * *